US008251876B2

(12) United States Patent
Boerst et al.

(10) Patent No.: US 8,251,876 B2
(45) Date of Patent: Aug. 28, 2012

(54) BREATHING EXERCISE APPARATUS

(75) Inventors: Chad M. Boerst, Daniel Island, SC (US); John A. Bobey, Daniel Island, SC (US); Brian E. Byrd, Summerville, SC (US); Rollie J. Kitchens, Mount Pleasant, SC (US); Matthew M. Lambert, Summerville, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 589 days.

(21) Appl. No.: 12/107,150

(22) Filed: Apr. 22, 2008

(65) Prior Publication Data

US 2009/0264256 A1 Oct. 22, 2009

(51) Int. Cl.
*A63B 21/00* (2006.01)

(52) U.S. Cl. ..... 482/13; 128/203.12

(58) Field of Classification Search ..... 128/204.18, 128/204.19; 482/13

See application file for complete search history.

(56) References Cited

U.S. PATENT DOCUMENTS

| | | | |
|---|---|---|---|
| 2,098,280 | A | 11/1937 | Dornseif |
| 3,628,280 | A | 12/1971 | Nave |
| 3,710,780 | A | 1/1973 | Milch |
| 3,863,914 | A | 2/1975 | O'Connor |
| 3,908,987 | A | 9/1975 | Boehringer |
| 3,922,525 | A | 11/1975 | Kozak et al. |
| 3,936,048 | A | 2/1976 | Dunlap et al. |
| 3,949,737 | A | 4/1976 | Nielsen |
| 3,949,984 | A | 4/1976 | Navara |
| 3,958,565 | A | 5/1976 | Wright |
| 3,972,326 | A | 8/1976 | Brawn |
| 3,977,395 | A | 8/1976 | Brawn |
| 3,977,399 | A | 8/1976 | Brawn |
| D242,956 | S | 1/1977 | Miller et al. |
| 4,010,946 | A | 3/1977 | Miller |
| 4,025,070 | A | 5/1977 | McGill et al. |
| 4,037,836 | A | 7/1977 | Puderbaugh et al. |
| 4,041,935 | A | 8/1977 | Garbe |
| 4,054,134 | A | 10/1977 | Kritzer |
| 4,060,074 | A | 11/1977 | Russo |
| 4,062,358 | A | 12/1977 | Kritzer |
| 4,086,918 | A | 5/1978 | Russo |
| 4,094,508 | A | 6/1978 | Kirsch |
| 4,096,855 | A | 6/1978 | Fleury, Jr. |

(Continued)

FOREIGN PATENT DOCUMENTS

EP 0681853 A1 4/1995

OTHER PUBLICATIONS

"Quake® Vibratory PEP Device", Thayer Medical Corp., (2 pages).

(Continued)

*Primary Examiner* — Jerome W Donnelly
(74) *Attorney, Agent, or Firm* — Barnes & Thornburg LLP

(57) ABSTRACT

A breathing exercise apparatus comprises a chamber having a vent open to the atmosphere, a mouthpiece having an opening, a first member having a plurality of apertures positioned in the chamber between the opening in the mouthpiece and the vent, a second member having a plurality of apertures positioned in the chamber adjacent the first member, and a motor coupled to the second member and operable to move the second member with respect to the first member such that the apertures in the second member intermittently align with the apertures in the first member to vary the resistance a user experiences when both inhaling and exhaling through the apparatus.

21 Claims, 9 Drawing Sheets

U.S. PATENT DOCUMENTS

| | | | |
|---|---|---|---|
| 4,114,607 | A | 9/1978 | Russo |
| 4,114,608 | A | 9/1978 | Russo |
| 4,114,616 | A | 9/1978 | Brawn |
| 4,121,583 | A | 10/1978 | Chen |
| 4,138,105 | A | 2/1979 | Hunger et al. |
| 4,143,872 | A | 3/1979 | Havstad et al. |
| 4,144,883 | A | 3/1979 | Crieshaber |
| 4,158,360 | A | 6/1979 | Adams |
| 4,170,228 | A | 10/1979 | Elson et al. |
| 4,171,804 | A | 10/1979 | Thead, Jr. |
| 4,176,663 | A | 12/1979 | Hewlett |
| 4,182,347 | A | 1/1980 | Russo |
| 4,182,599 | A | 1/1980 | Eyrick et al. |
| 4,183,361 | A | 1/1980 | Russo |
| D254,324 | S | 2/1980 | Thead, Jr. |
| D254,443 | S | 3/1980 | Adams |
| 4,221,381 | A | 9/1980 | Ericson |
| 4,231,375 | A | 11/1980 | Boehringer et al. |
| 4,232,683 | A | 11/1980 | Bartholomew et al. |
| 4,233,990 | A | 11/1980 | Yardley |
| 4,241,739 | A | 12/1980 | Elson |
| 4,241,740 | A | 12/1980 | Brown |
| 4,245,633 | A | 1/1981 | Erceg |
| 4,282,883 | A | 8/1981 | Yerushalmy |
| 4,284,083 | A | 8/1981 | Lester |
| 4,291,704 | A | 9/1981 | Petty et al. |
| 4,299,236 | A | 11/1981 | Poirier |
| 4,301,810 | A | 11/1981 | Belman |
| 4,323,078 | A | 4/1982 | Heimlich |
| 4,324,260 | A | 4/1982 | Puderbaugh |
| 4,327,740 | A | 5/1982 | Shuman |
| 4,327,741 | A | 5/1982 | Watson et al. |
| 4,333,452 | A | 6/1982 | Au |
| 4,345,605 | A | 8/1982 | Gereg |
| 4,347,853 | A | 9/1982 | Gereg et al. |
| 4,363,328 | A | 12/1982 | Poirier et al. |
| D269,124 | S | 5/1983 | McCombs et al. |
| 4,391,283 | A | 7/1983 | Sharpless et al. |
| 4,403,616 | A | 9/1983 | King |
| 4,421,113 | A | 12/1983 | Gedeon et al. |
| 4,425,923 | A | 1/1984 | Gordon et al. |
| 4,436,090 | A | 3/1984 | Darling |
| 4,441,505 | A | 4/1984 | Edwards et al. |
| 4,441,506 | A | 4/1984 | McCombs et al. |
| 4,444,202 | A | 4/1984 | Rubin et al. |
| 4,470,412 | A | 9/1984 | Nowacki et al. |
| 4,473,082 | A | 9/1984 | Gereg |
| 4,487,207 | A | 12/1984 | Fitz |
| 4,495,944 | A | 1/1985 | Brisson et al. |
| 4,499,905 | A | 2/1985 | Greenberg et al. |
| 4,506,883 | A | 3/1985 | Rathbun |
| 4,533,137 | A | 8/1985 | Sonne |
| 4,534,343 | A | 8/1985 | Nowacki et al. |
| 4,579,124 | A | 4/1986 | Jentges |
| 4,585,012 | A | 4/1986 | Rumburg |
| 4,595,196 | A | 6/1986 | Muchisky et al. |
| 4,601,465 | A | 7/1986 | Roy |
| 4,619,532 | A | 10/1986 | Schmidt, III |
| 4,621,631 | A | 11/1986 | Páques et al. |
| 4,632,610 | A | 12/1986 | Hougen |
| 4,634,117 | A | 1/1987 | Kramer |
| 4,635,647 | A | 1/1987 | Choksi |
| 4,638,812 | A | 1/1987 | Häkkinen |
| 4,654,009 | A | 3/1987 | Greene |
| D293,613 | S | 1/1988 | Wingler |
| 4,739,987 | A | 4/1988 | Nicholson |
| 4,766,894 | A | 8/1988 | Legrand et al. |
| 4,767,785 | A | 8/1988 | Georgieff |
| 4,770,413 | A | 9/1988 | Green |
| 4,787,627 | A | 11/1988 | Daubenspeck |
| 4,796,614 | A | 1/1989 | Nowacki et al. |
| 4,809,692 | A | 3/1989 | Nowacki et al. |
| 4,813,819 | A | 3/1989 | Hougen |
| 4,821,713 | A | 4/1989 | Bauman |
| 4,823,828 | A | 4/1989 | McGinnis |
| 4,824,105 | A | 4/1989 | Goldenberg |
| 4,832,015 | A | 5/1989 | Nowacki et al. |
| 4,838,257 | A | 6/1989 | Hatch |
| 4,854,574 | A | 8/1989 | Larson et al. |
| 4,889,137 | A | 12/1989 | Kolobow |
| 4,915,103 | A | 4/1990 | Visveshwara et al. |
| 4,938,210 | A | 7/1990 | Shene |
| 4,951,661 | A | 8/1990 | Sladek |
| 4,952,102 | A | 8/1990 | Hougen |
| 4,964,404 | A | 10/1990 | Stone |
| 4,967,742 | A | 11/1990 | Theodorou |
| 4,973,047 | A | 11/1990 | Norell |
| 4,981,295 | A | 1/1991 | Belman et al. |
| 4,982,735 | A | 1/1991 | Yagata et al. |
| 4,986,269 | A | 1/1991 | Hakkinen |
| 5,002,050 | A | 3/1991 | McGinnis |
| 5,012,803 | A | 5/1991 | Foley et al. |
| 5,012,804 | A | 5/1991 | Foley et al. |
| 5,018,517 | A | 5/1991 | Liardet |
| 5,027,809 | A | 7/1991 | Robinson |
| 5,042,467 | A | 8/1991 | Foley |
| 5,054,478 | A | 10/1991 | Grychowski et al. |
| 5,060,655 | A | 10/1991 | Rudolph |
| 5,067,707 | A | 11/1991 | Kohnke |
| 5,069,449 | A | 12/1991 | Wardwell |
| 5,072,729 | A | 12/1991 | DeVries |
| 5,074,295 | A | 12/1991 | Willis |
| 5,078,131 | A | 1/1992 | Foley |
| 5,107,830 | A | 4/1992 | Younes |
| 5,127,400 | A | 7/1992 | DeVries et al. |
| 5,129,390 | A | 7/1992 | Chopin et al. |
| 5,133,700 | A | 7/1992 | Braathen |
| 5,134,996 | A | 8/1992 | Bell |
| 5,145,296 | A | 9/1992 | Hougen |
| 5,148,802 | A | 9/1992 | Sanders et al. |
| 5,150,291 | A | 9/1992 | Cummings et al. |
| 5,154,167 | A | 10/1992 | Hepburn |
| 5,165,393 | A | 11/1992 | Kawaguchi |
| 5,193,529 | A | 3/1993 | Labaere |
| 5,203,650 | A | 4/1993 | McCourtney |
| 5,245,991 | A | 9/1993 | Kawaguchi |
| 5,246,010 | A | 9/1993 | Gazzara et al. |
| 5,253,651 | A | 10/1993 | Stockwell et al. |
| 5,255,687 | A | 10/1993 | McKenna |
| D340,975 | S | 11/1993 | Sladek |
| 5,261,394 | A | 11/1993 | Mulligan et al. |
| 5,277,195 | A | 1/1994 | Williams |
| 5,303,699 | A | 4/1994 | Bonassa et al. |
| 5,307,795 | A | 5/1994 | Whitwam et al. |
| 5,309,906 | A | 5/1994 | LaBombard |
| 5,315,990 | A | 5/1994 | Mondry |
| 5,342,260 | A | 8/1994 | Markland |
| 5,355,873 | A | 10/1994 | Del Bon et al. |
| 5,357,975 | A | 10/1994 | Kraemer et al. |
| 5,370,113 | A | 12/1994 | Parsons |
| 5,372,118 | A | 12/1994 | Schmidt, III et al. |
| 5,373,851 | A | 12/1994 | Reinhold, Jr. et al. |
| 5,392,768 | A | 2/1995 | Johansson et al. |
| 5,393,281 | A | 2/1995 | Chen |
| 5,394,866 | A | 3/1995 | Ritson et al. |
| 5,398,676 | A | 3/1995 | Press et al. |
| 5,400,777 | A | 3/1995 | Olsson et al. |
| 5,404,871 | A | 4/1995 | Goodman et al. |
| 5,413,110 | A | 5/1995 | Cummings et al. |
| 5,413,112 | A | 5/1995 | Jansen et al. |
| 5,415,161 | A | 5/1995 | Ryder |
| 5,415,165 | A | 5/1995 | Fiddian-Green |
| 5,423,313 | A | 6/1995 | Olsson et al. |
| 5,433,193 | A | 7/1995 | Sanders et al. |
| 5,433,216 | A | 7/1995 | Sugrue et al. |
| 5,439,430 | A | 8/1995 | Rubens et al. |
| D362,500 | S | 9/1995 | Cook et al. |
| 5,449,751 | A | 9/1995 | Forssmann et al. |
| 5,451,190 | A | 9/1995 | Liardet |
| 5,451,408 | A | 9/1995 | Mezei et al. |
| 5,456,251 | A | 10/1995 | Fiddian-Green |
| 5,461,934 | A | 10/1995 | Budd |
| D365,581 | S | 12/1995 | McCourtney |
| 5,474,058 | A | 12/1995 | Lix |
| 5,479,920 | A | 1/1996 | Piper et al. |
| 5,487,378 | A | 1/1996 | Robertson et al. |
| 5,490,498 | A | 2/1996 | Faithfull et al. |

5,490,502 A 2/1996 Rapoport et al.
5,494,028 A 2/1996 DeVries et al.
5,507,282 A 4/1996 Younes
5,509,404 A 4/1996 Lloyd et al.
5,509,870 A 4/1996 Lloyd
5,518,002 A 5/1996 Wolf et al.
5,522,378 A 6/1996 Ritson et al.
5,526,809 A 6/1996 Fiddian-Green
5,535,738 A 7/1996 Estes et al.
5,535,739 A 7/1996 Rapoport et al.
5,540,234 A 7/1996 Lalui
5,542,410 A 8/1996 Goodman et al.
5,546,933 A 8/1996 Rapoport et al.
5,547,440 A 8/1996 Rubens et al.
5,549,106 A 8/1996 Gruenke et al.
5,551,419 A 9/1996 Froehlich et al.
5,555,880 A 9/1996 Winter et al.
5,558,085 A 9/1996 Rubsamen et al.
5,558,086 A 9/1996 Smith et al.
5,560,353 A 10/1996 Willemot et al.
5,560,371 A 10/1996 Carvalho da Silva
5,569,122 A 10/1996 Cegla
5,570,682 A 11/1996 Johnson
5,572,993 A 11/1996 Kurome et al.
5,575,283 A 11/1996 Sjoestrand
5,582,163 A 12/1996 Bonassa
5,595,166 A 1/1997 Schmidt, III et al.
5,598,838 A 2/1997 Servidio et al.
5,598,839 A 2/1997 Niles et al.
5,601,078 A 2/1997 Schaller et al.
5,613,489 A 3/1997 Miller et al.
5,613,497 A 3/1997 DeBush
5,617,846 A 4/1997 Graetz et al.
5,617,847 A 4/1997 Howe
5,622,162 A 4/1997 Johansson et al.
5,626,131 A 5/1997 Chua et al.
5,627,324 A 5/1997 Shene
5,632,269 A 5/1997 Zdrojkowski
5,632,298 A 5/1997 Artinian
5,642,730 A 7/1997 Baram
5,645,049 A 7/1997 Foley et al.
5,647,351 A 7/1997 Weismann et al.
5,649,533 A 7/1997 Oren
5,655,516 A 8/1997 Goodman et al.
5,655,521 A 8/1997 Faithfull et al.
5,658,221 A 8/1997 Hougen
5,660,166 A 8/1997 Lloyd et al.
5,664,562 A 9/1997 Bourdon
5,665,861 A 9/1997 Forssmann et al.
5,685,296 A 11/1997 Zdrojkowski et al.
5,686,409 A 11/1997 McFadden et al.
5,694,923 A 12/1997 Hete et al.
5,697,364 A 12/1997 Chua et al.
5,730,120 A 3/1998 Yonkers, Jr.
5,740,796 A 4/1998 Skog
5,740,797 A 4/1998 Dickson
5,743,252 A 4/1998 Rubsamen et al.
5,749,368 A 5/1998 Kase
5,752,509 A 5/1998 Lachmann et al.
5,755,640 A 5/1998 Frolov et al.
5,771,884 A 6/1998 Yarnall et al.
5,788,631 A 8/1998 Fiddian-Green
5,791,339 A 8/1998 Winter
5,794,615 A 8/1998 Estes
5,797,393 A 8/1998 Kohl
5,799,652 A 9/1998 Kotliar
5,803,065 A 9/1998 Zdrojkowski et al.
5,803,066 A 9/1998 Rapoport et al.
5,813,397 A 9/1998 Goodman et al.
5,813,400 A 9/1998 Bühlmann et al.
5,816,246 A 10/1998 Mirza
5,819,726 A 10/1998 Rubsamen et al.
5,823,179 A 10/1998 Grychowski et al.
5,829,429 A 11/1998 Hughes
5,834,419 A 11/1998 McFadden et al.
5,839,434 A 11/1998 Enterline
5,848,588 A 12/1998 Foley et al.
5,853,003 A 12/1998 Faithfull et al.
5,875,777 A 3/1999 Eriksson
5,878,743 A 3/1999 Zdrojkowski et al.
5,878,744 A 3/1999 Pfeiffer
5,881,722 A 3/1999 DeVries et al.
5,881,724 A 3/1999 Graetz et al.
5,881,772 A 3/1999 Bennett
5,890,998 A 4/1999 Hougen
5,899,832 A 5/1999 Hougen
5,910,071 A 6/1999 Hougen
5,915,381 A 6/1999 Nord
5,917,014 A 6/1999 McFadden et al.
5,921,238 A 7/1999 Bourdon
5,927,274 A 7/1999 Servidio et al.
5,931,159 A 8/1999 Suzuki et al.
5,931,162 A 8/1999 Christian
5,931,163 A 8/1999 Stegmann et al.
5,937,853 A 8/1999 Ström
5,937,854 A 8/1999 Stenzler
5,937,855 A 8/1999 Zdrojkowski et al.
5,937,857 A 8/1999 Caterini et al.
5,939,525 A 8/1999 McFadden et al.
5,954,049 A 9/1999 Foley et al.
5,957,124 A 9/1999 Lloyd et al.
5,960,792 A 10/1999 Lloyd et al.
5,964,223 A 10/1999 Baran
5,984,873 A 11/1999 Crumb et al.
5,988,160 A 11/1999 Foley et al.
6,003,511 A 12/1999 Fukunaga et al.
6,006,748 A 12/1999 Hollis
6,009,871 A 1/2000 Kiske et al.
6,010,453 A 1/2000 Fiddian-Green
6,010,460 A 1/2000 McNaughton
6,014,972 A 1/2000 Sladek
6,024,090 A 2/2000 Gonda et al.
6,029,660 A 2/2000 Calluaud et al.
6,029,664 A 2/2000 Zdrojkowski et al.
6,032,667 A 3/2000 Heinonen
6,035,896 A 3/2000 Liardet
6,038,913 A 3/2000 Gustafsson et al.
6,039,042 A 3/2000 Sladek
6,042,509 A 3/2000 Wu et al.
6,044,841 A 4/2000 Verdun et al.
6,058,932 A 5/2000 Hughes
6,073,630 A 6/2000 Adahan
6,076,519 A 6/2000 Johnson
6,079,412 A 6/2000 Meier et al.
6,079,413 A 6/2000 Baran
6,082,357 A 7/2000 Bates et al.
6,082,358 A 7/2000 Scarrott et al.
6,083,141 A 7/2000 Hougen
6,085,746 A 7/2000 Fox
6,089,105 A 7/2000 Ricciardelli
D429,330 S 8/2000 Hoenig
6,095,140 A 8/2000 Poon et al.
6,098,620 A 8/2000 Lloyd et al.
6,102,038 A 8/2000 DeVries
6,102,042 A 8/2000 Hete et al.
6,105,575 A 8/2000 Estes et al.
6,119,684 A 9/2000 Nöhl et al.
6,119,687 A 9/2000 Faithfull et al.
6,129,086 A 10/2000 Gzybowski et al.
6,131,853 A 10/2000 Bauer et al.
6,135,106 A 10/2000 Dirks et al.
6,142,339 A 11/2000 Blacker et al.
6,161,499 A 12/2000 Sun et al.
6,161,724 A 12/2000 Blacker et al.
6,165,105 A 12/2000 Boutellier et al.
6,167,881 B1 1/2001 Hughes
6,182,657 B1 2/2001 Brydon et al.
6,186,142 B1 2/2001 Schmidt et al.
6,192,876 B1 2/2001 Denyer et al.
D439,534 S 3/2001 Scarrott et al.
6,196,222 B1 3/2001 Heinonen et al.
6,202,643 B1 3/2001 Sladek
D440,651 S 4/2001 Foran et al.
D441,070 S 4/2001 Niles et al.
6,210,345 B1 4/2001 Van Brunt
6,213,119 B1 4/2001 Brydon et al.
6,240,919 B1 6/2001 MacDonald et al.
6,253,766 B1 7/2001 Niles et al.

6,257,234 B1 7/2001 Sun
6,273,087 B1 8/2001 Boussignac et al.
6,280,123 B1 8/2001 Gill
D447,432 S 9/2001 Scarrott et al.
6,283,119 B1 9/2001 Bourdon
6,283,122 B1 9/2001 Adahan
6,283,365 B1 9/2001 Bason
6,289,892 B1 9/2001 Faithfull et al.
6,293,279 B1 9/2001 Schmidt et al.
6,302,105 B1 10/2001 Wickham et al.
6,305,372 B1 10/2001 Servidio
6,305,374 B1 10/2001 Zdrojkowski et al.
D450,381 S 11/2001 Weinstein et al.
6,328,037 B1 12/2001 Scarrott et al.
6,334,064 B1 12/2001 Fiddian-Green
6,336,453 B1 1/2002 Scarrott et al.
6,340,025 B1 1/2002 Van Brunt
6,345,617 B1 2/2002 Engelbreth et al.
6,345,619 B1 2/2002 Finn
6,360,740 B1 3/2002 Ward et al.
6,360,745 B1 3/2002 Wallace et al.
D456,292 S 4/2002 Scarrott et al.
6,363,933 B1 4/2002 Berthon-Jones
6,367,474 B1 4/2002 Berthon-Jones et al.
6,371,115 B1 4/2002 Cewers et al.
6,378,520 B1 4/2002 Davenport
6,379,316 B1 4/2002 Van Brunt et al.
6,390,088 B1 5/2002 Nöhl et al.
6,397,845 B1 6/2002 Burton
6,401,713 B1 6/2002 Hill et al.
6,405,728 B1 6/2002 Van Hall et al.
6,409,638 B1 6/2002 Huston
6,415,791 B1 7/2002 Van Brunt
6,425,393 B1 7/2002 Lurie et al.
6,431,171 B1 8/2002 Burton
6,435,177 B1 8/2002 Schmidt et al.
6,435,372 B1 8/2002 Blacker et al.
6,439,228 B1 8/2002 Hete et al.
6,450,163 B1 9/2002 Blacker et al.
6,450,969 B1 9/2002 Farr et al.
6,454,680 B1 9/2002 Taimela
6,471,621 B2 10/2002 Hörstel et al.
6,484,719 B1 11/2002 Berthon-Jones
6,495,515 B1 12/2002 McFadden et al.
6,500,095 B1 12/2002 Hougen
6,502,572 B1 1/2003 Berthon-Jones et al.
6,514,177 B1 2/2003 Brugger et al.
6,526,970 B2 3/2003 DeVries et al.
6,526,974 B1 3/2003 Brydon et al.
6,526,976 B1 3/2003 Baran
6,530,372 B1 3/2003 Madaus et al.
6,532,956 B2 3/2003 Hill
6,536,433 B1 3/2003 Cewers
6,539,938 B2 4/2003 Weinstein et al.
6,539,940 B2 4/2003 Zdrojkowski et al.
6,543,449 B1 4/2003 Woodring et al.
6,550,473 B1 4/2003 Sladek
6,554,746 B1 4/2003 McConnell et al.
6,557,549 B2 5/2003 Schmidt et al.
6,558,221 B1 5/2003 Yang
6,561,384 B2 5/2003 Blacker et al.
6,568,387 B2 5/2003 Davenport et al.
6,581,595 B1 6/2003 Murdock et al.
6,581,596 B1 6/2003 Truitt et al.
6,581,598 B1 6/2003 Foran et al.
6,581,697 B1 6/2003 Giardino
6,581,896 B1 6/2003 Olexovitch
6,588,422 B1 7/2003 Berthon-Jones et al.
6,588,427 B1 7/2003 Carlsen et al.
6,589,933 B1 7/2003 McFadden et al.
6,609,517 B1 8/2003 Estes et al.
6,612,303 B1 9/2003 Grychowski et al.
6,615,831 B1 9/2003 Tuitt et al.
6,622,724 B1 9/2003 Truitt et al.
6,626,175 B2 9/2003 Jafari et al.
6,631,716 B1 10/2003 Robinson et al.
6,631,721 B1 10/2003 Salter et al.
6,644,304 B2 11/2003 Grychowski et al.
6,644,305 B2 11/2003 MacRae et al.
6,651,654 B2 11/2003 Rogacki
6,656,129 B2 12/2003 Niles et al.
RE38,407 E 1/2004 Mezel et al.
6,672,300 B1 1/2004 Grant
6,679,252 B2 1/2004 Sladek
6,679,258 B1 1/2004 Ström
6,691,579 B2 2/2004 Orr et al.
6,694,969 B1 2/2004 Heinonen et al.
6,694,978 B1 2/2004 Bennarsten
6,702,720 B2 3/2004 Dardik
6,702,769 B1 3/2004 Fowler-Hawkins
6,702,998 B2 3/2004 Conner
6,708,688 B1 3/2004 Rubin et al.
6,708,690 B1 3/2004 Hete et al.
D489,129 S 4/2004 King et al.
6,718,969 B1 4/2004 Rubin et al.
6,722,362 B2 4/2004 Hete et al.
6,723,024 B2 4/2004 Levine
6,726,598 B1 4/2004 Jarvis et al.
D490,519 S 5/2004 Pelerossi et al.
6,729,330 B2 5/2004 Scarrott et al.
6,729,334 B1 5/2004 Baran
6,745,760 B2 6/2004 Grychowski et al.
6,748,945 B2 6/2004 Grychowski et al.
6,752,151 B2 6/2004 Hill
6,761,161 B2 7/2004 Scarrott et al.
6,761,165 B2 7/2004 Strickland, Jr.
6,766,800 B2 7/2004 Chu et al.
6,776,159 B2 8/2004 Pelerossi et al.
6,792,942 B1 9/2004 Ho et al.
6,805,118 B2 10/2004 Brooker et al.
6,805,120 B1 10/2004 Jeffrey et al.
6,814,074 B1 11/2004 Nadjafizadeh et al.
6,814,076 B2 11/2004 Shusterman et al.
6,817,361 B2 11/2004 Berthon-Jones et al.
6,820,613 B2 11/2004 Wenkebach et al.
6,823,866 B2 11/2004 Jafari et al.
6,837,260 B1 1/2005 Kuehn
6,848,443 B2 2/2005 Schmidt et al.
6,851,425 B2 2/2005 Jeffre et al.
6,854,462 B2 2/2005 Berthon-Jones et al.
6,860,265 B1 3/2005 Emerson
6,863,068 B2 3/2005 Jamison et al.
6,866,040 B1 3/2005 Bourdon
6,877,511 B2 4/2005 DeVries et al.
6,880,556 B2 4/2005 Uchiyama et al.
6,889,691 B2 5/2005 Eklund et al.
6,894,155 B2 5/2005 McFadden et al.
6,904,906 B2 6/2005 Salter et al.
6,904,908 B2 6/2005 Bruce et al.
6,907,881 B2 6/2005 Suki et al.
6,910,479 B1 6/2005 Van Brunt
6,914,076 B2 7/2005 Cavazza
6,915,705 B1 7/2005 Truitt et al.
6,915,803 B2 7/2005 Berthon-Jones et al.
6,920,875 B1 7/2005 Hill et al.
6,920,877 B2 7/2005 Remmers et al.
6,920,878 B2 7/2005 Sinderby et al.
6,926,002 B2 8/2005 Scarrott et al.
6,929,003 B2 8/2005 Blacker et al.
6,929,007 B2 8/2005 Emerson
6,932,084 B2 8/2005 Estes et al.
6,935,338 B1 8/2005 Triunfo, Jr.
6,938,619 B1 9/2005 Hickle
6,938,796 B2 9/2005 Blacker et al.
6,948,497 B2 9/2005 Zdrojkowski et al.
6,953,039 B2 10/2005 Scarrott et al.
6,968,741 B2 11/2005 Orr et al.
6,976,491 B2 12/2005 D'Agosto
6,984,214 B2 1/2006 Fowler-Hawkins
6,988,498 B2 1/2006 Berthon-Jones et al.
6,988,994 B2 1/2006 Rapoport et al.
6,994,083 B2 2/2006 Foley et al.
6,997,349 B2 2/2006 Blacker et al.
7,000,612 B2 2/2006 Jafari et al.
7,004,164 B2 2/2006 Scarrott
7,007,693 B2 3/2006 Fuhrman et al.
7,011,087 B1 3/2006 Sullivan
7,011,091 B2 3/2006 Hill et al.

7,013,896 B2 3/2006 Schmidt
7,036,500 B2 5/2006 Niles et al.
7,040,318 B2 5/2006 Däscher et al.
7,044,129 B1 5/2006 Truschel et al.
7,059,324 B2 6/2006 Pelerossi et al.
7,077,141 B2 7/2006 Troop
7,080,643 B2 7/2006 Grychowski et al.
7,096,866 B2 8/2006 Be'eri et al.
7,100,530 B2 9/2006 Lu
7,100,607 B2 9/2006 Zdrojkowski et al.
7,101,559 B2 9/2006 McFadden et al.
7,121,277 B2 10/2006 Ström
7,134,434 B2 11/2006 Truitt et al.
7,143,908 B2 12/2006 Blacker et al.
7,159,973 B2 1/2007 Buchanan et al.
7,162,296 B2 1/2007 Leonhardt et al.
7,165,547 B2 * 1/2007 Truitt et al. ..... 128/204.21
7,174,789 B2 2/2007 Orr et al.
7,178,522 B2 2/2007 Baker et al.
7,186,221 B2 3/2007 Rapoport et al.
7,191,776 B2 3/2007 Niles et al.
7,191,782 B2 3/2007 Madsen
7,191,783 B2 3/2007 Russell
7,201,164 B2 4/2007 Grychowski et al.
7,201,165 B2 4/2007 Bruce et al.
7,210,478 B2 5/2007 Banner et al.
7,225,807 B2 6/2007 Papania et al.
7,232,417 B2 6/2007 Plante
7,241,269 B2 7/2007 McCawley et al.
7,246,618 B2 7/2007 Habashi
7,267,122 B2 9/2007 Hill
7,270,123 B2 9/2007 Grychowski et al.
7,270,128 B2 9/2007 Berthon-Jones et al.
7,296,573 B2 11/2007 Estes et al.
7,322,937 B2 1/2008 Blomberg et al.
D561,330 S 2/2008 Richards et al.
7,338,410 B2 3/2008 Dardik
7,341,057 B2 3/2008 Scarrott et al.
7,341,059 B2 3/2008 Moody et al.
7,347,203 B2 3/2008 Marler et al.
D566,833 S 4/2008 Richards et al.
7,353,824 B1 4/2008 Forsyth et al.
7,360,537 B2 4/2008 Snyder et al.
RE40,402 E 6/2008 Leonhardt et al.
7,390,305 B2 6/2008 Nuttall
7,406,966 B2 8/2008 Wondka
7,419,670 B2 9/2008 Zhong et al.
7,422,014 B1 9/2008 Smith
7,431,031 B2 10/2008 Hete et al.
7,448,381 B2 11/2008 Sasaki et al.
7,448,383 B2 11/2008 Delache et al.
7,469,700 B2 12/2008 Baran
7,472,702 B2 1/2009 Beck et al.
7,472,705 B2 1/2009 Baran
7,478,635 B2 1/2009 Wixey et al.
2001/0004893 A1 6/2001 Biondi et al.
2001/0004894 A1 6/2001 Bourdon
2001/0039951 A1 11/2001 Strickland, Jr.
2001/0047805 A1 12/2001 Scarberry et al.
2002/0000228 A1 1/2002 Schoeb
2002/0005197 A1 1/2002 DeVries et al.
2002/0007831 A1 1/2002 Davenport et al.
2002/0023645 A1 2/2002 Zdrojkowski et al.
2002/0026935 A1 3/2002 Schmidt et al.
2002/0026940 A1 3/2002 Brooker et al.
2002/0029779 A1 3/2002 Schmidt et al.
2002/0073993 A1 6/2002 Weinstein et al.
2002/0082512 A1 6/2002 Strom
2002/0088465 A1 7/2002 Hill
2002/0096173 A1 7/2002 Berthon-Jones et al.
2002/0115533 A1 8/2002 Horstel et al.
2002/0121278 A1 9/2002 Hete et al.
2002/0134704 A1 9/2002 Mitchell et al.
2002/0172645 A1 11/2002 Conner
2003/0000528 A1 1/2003 Eklund et al.
2003/0056788 A1 3/2003 Faithfull et al.
2003/0062045 A1 4/2003 Woodring et al.
2003/0066528 A1 4/2003 Hill et al.
2003/0121519 A1 7/2003 Estes et al.
2003/0127092 A1 7/2003 Pelerossi et al.
2003/0140925 A1 7/2003 Sapienza et al.
2003/0145856 A1 8/2003 Zdrojkowski et al.
2003/0205229 A1 11/2003 Crockford et al.
2003/0205230 A1 11/2003 Shusterman et al.
2003/0213488 A1 11/2003 Remmers et al.
2003/0213491 A1 11/2003 Berthon-Jones et al.
2003/0221689 A1 12/2003 Berthon-Jones
2003/0226562 A1 12/2003 Schmidt et al.
2003/0230307 A1 12/2003 DeVries et al.
2003/0234017 A1 12/2003 Pelerosse et al.
2004/0000310 A1 1/2004 Wickham et al.
2004/0025870 A1 2/2004 Harrison et al.
2004/0033200 A1 2/2004 Ezban et al.
2004/0035417 A1 2/2004 Ottolangui
2004/0040557 A1 3/2004 Salter et al.
2004/0063544 A1 4/2004 Lawson
2004/0074494 A1 4/2004 Frater
2004/0084049 A1 5/2004 Baran
2004/0084050 A1 5/2004 Baran
2004/0097821 A1 5/2004 Blomberg et al.
2004/0097850 A1 5/2004 Plante
2004/0100477 A1 5/2004 Morita et al.
2004/0103896 A1 6/2004 Jafari et al.
2004/0112382 A1 6/2004 Schneider et al.
2004/0133123 A1 7/2004 Leonhardt et al.
2004/0134492 A1 7/2004 Dardik
2004/0156917 A1 8/2004 Conner
2004/0158178 A1 8/2004 Fowler-Hawkins
2004/0173209 A1 9/2004 Grychowski et al.
2004/0200477 A1 10/2004 Bleys et al.
2004/0211422 A1 10/2004 Arcilla et al.
2004/0221848 A1 11/2004 Hill
2004/0221851 A1 11/2004 Madsen
2004/0221854 A1 11/2004 Hete et al.
2004/0226562 A1 11/2004 Bordewick
2004/0255943 A1 12/2004 Morris et al.
2005/0005935 A1 1/2005 Gradon
2005/0005936 A1 1/2005 Wondka
2005/0005937 A1 1/2005 Farrugia et al.
2005/0005938 A1 1/2005 Berthon-Jones et al.
2005/0016536 A1 1/2005 Rapoport et al.
2005/0034727 A1 2/2005 Shusterman et al.
2005/0038353 A1 2/2005 Rapoport et al.
2005/0039746 A1 2/2005 Grychowski et al.
2005/0061321 A1 3/2005 Jones
2005/0076910 A1 4/2005 Berthon-Jones et al.
2005/0081859 A1 4/2005 Scarberry et al.
2005/0087187 A1 4/2005 Berthon-Jones et al.
2005/0087190 A1 4/2005 Jafari et al.
2005/0092321 A1 5/2005 Aylsworth et al.
2005/0098175 A1 5/2005 Stradella
2005/0098176 A1 5/2005 Hoffrichter
2005/0098179 A1 5/2005 Burton et al.
2005/0109340 A1 5/2005 Tehrani
2005/0125002 A1 6/2005 Baran et al.
2005/0126573 A1 6/2005 Jaffre et al.
2005/0139212 A1 6/2005 Bourdon
2005/0165334 A1 7/2005 Lurie
2005/0166920 A1 8/2005 Delache et al.
2005/0172960 A1 8/2005 Gutsell et al.
2005/0176761 A1 8/2005 Pregel et al.
2005/0188991 A1 9/2005 Sun et al.
2005/0203008 A1 9/2005 Johansson et al.
2005/0205085 A1 9/2005 Blacker et al.
2005/0205512 A1 9/2005 Scarrott et al.
2005/0211248 A1 9/2005 Lauk et al.
2005/0211249 A1 9/2005 Wagner et al.
2005/0224078 A1 10/2005 Zdrojkowski et al.
2005/0229931 A1 10/2005 Denyer et al.
2005/0235985 A1 10/2005 Niles et al.
2005/0235993 A1 10/2005 Baecker et al.
2005/0241639 A1 11/2005 Zilberg
2005/0247313 A1 11/2005 Niles et al.
2005/0247315 A1 11/2005 Estes et al.
2005/0268912 A1 12/2005 Norman et al.
2005/0268913 A1 12/2005 Morris et al.
2005/0274379 A1 12/2005 Bruce et al.
2005/0274381 A1 12/2005 Deane et al.

2005/0283089 A1 12/2005 Sullivan et al.
2005/0284476 A1 12/2005 Blanch et al.
2006/0002887 A1 1/2006 Fitzpatrick et al.
2006/0002888 A1 1/2006 Fitzpatrick et al.
2006/0002889 A1 1/2006 Fitzpatrick et al.
2006/0005834 A1 1/2006 Aylsworth et al.
2006/0011195 A1 1/2006 Zarychta
2006/0011197 A1 1/2006 Hodson
2006/0011200 A1 1/2006 Remmers et al.
2006/0021618 A1 2/2006 Berthon-Jones et al.
2006/0032503 A1 2/2006 Berthon-Jones et al.
2006/0070625 A1 4/2006 Ayappa et al.
2006/0079799 A1 4/2006 Green et al.
2006/0086358 A1 4/2006 Kushnir et al.
2006/0090753 A1 5/2006 Pelerossi et al.
2006/0096594 A1 5/2006 Bonney et al.
2006/0102182 A1 5/2006 Scarrott et al.
2006/0107953 A1 5/2006 Truschel et al.
2006/0130835 A1 6/2006 Truschel et al.
2006/0144398 A1 7/2006 Doshi et al.
2006/0157052 A1 7/2006 Foley et al.
2006/0169281 A1 8/2006 Aylsworth et al.
2006/0178245 A1 8/2006 Schiller et al.
2006/0180150 A1 8/2006 Dittman
2006/0185673 A1 8/2006 Critzer et al.
2006/0196507 A1 9/2006 Bradley
2006/0196508 A1 9/2006 Chalvignac
2006/0201500 A1 9/2006 Von Hollen et al.
2006/0201502 A1 9/2006 Lieberman et al.
2006/0201505 A1 9/2006 Remmers et al.
2006/0201508 A1 9/2006 Forsyth et al.
2006/0201509 A1 9/2006 Forsyth et al.
2006/0213507 A1 9/2006 Foley et al.
2006/0213518 A1 9/2006 DeVries
2006/0217627 A1 9/2006 Nuttall
2006/0223675 A1 10/2006 Lew
2006/0237014 A1 10/2006 Makinson et al.
2006/0243274 A1 11/2006 Lieberman et al.
2006/0249153 A1 11/2006 DeVries et al.
2006/0249155 A1 11/2006 Gambone
2006/0272642 A1 12/2006 Chalvignac
2007/0000494 A1 1/2007 Banner et al.
2007/0017518 A1 1/2007 Farrugia et al.
2007/0023036 A1 2/2007 Grychowski et al.
2007/0032732 A1 2/2007 Shelley et al.
2007/0044796 A1 3/2007 Zdrojkowski et al.
2007/0056502 A1 3/2007 Lu
2007/0078086 A1 4/2007 Axelsen et al.
2007/0078087 A1 4/2007 Axelsen et al.
2007/0084467 A1 4/2007 Scarrott
2007/0089740 A1 4/2007 Baumert et al.
2007/0107719 A1 5/2007 Blacker et al.
2007/0151563 A1 7/2007 Ozaki et al.
2007/0175474 A1 8/2007 Scarrott et al.
2007/0185052 A1 8/2007 Yedgar et al.
2007/0193581 A1 8/2007 Laurila et al.
2007/0199566 A1 8/2007 Be'eri
2007/0204864 A1 9/2007 Grychowski et al.
2007/0225685 A1 9/2007 Plante
2007/0235028 A1 10/2007 Bruce et al.
2007/0256690 A1 11/2007 Faram
2007/0277823 A1 12/2007 Al-Ali et al.
2007/0283958 A1 12/2007 Naghavi
2008/0000475 A1 1/2008 Hill
2008/0000477 A1 1/2008 Huster et al.
2008/0000478 A1 1/2008 Matthiessen et al.
2008/0000479 A1 1/2008 Elaz et al.
2008/0011301 A1 1/2008 Qian
2008/0015456 A1 1/2008 McCawley et al.
2008/0021355 A1 1/2008 Huster et al.
2008/0029085 A1 2/2008 Lawrence et al.
2008/0029096 A1 2/2008 Kollmeyer et al.
2008/0043443 A1 2/2008 Nagao et al.
2008/0053438 A1 3/2008 DeVries et al.
2008/0053442 A1 3/2008 Estes et al.
2008/0053443 A1 3/2008 Estes et al.
2008/0053444 A1 3/2008 Estes et al.
2008/0053456 A1 3/2008 Brown et al.
2008/0060646 A1 3/2008 Isaza
2008/0060647 A1 3/2008 Messenger et al.
2008/0060656 A1 3/2008 Isaza
2008/0078383 A1 4/2008 Richards et al.
2008/0083407 A1 4/2008 Grychowski et al.
2008/0091117 A1 4/2008 Choncholas et al.
2008/0092894 A1 4/2008 Nicolazzi et al.
2008/0096728 A1 4/2008 Foley et al.
2008/0108905 A1 5/2008 Lurie
2008/0110451 A1 5/2008 Dunsmore et al.
2008/0110455 A1 5/2008 Dunsmore et al.
2008/0110461 A1 5/2008 Mulqueeny et al.
2008/0115786 A1 5/2008 Sinderby et al.
2008/0135735 A1 6/2008 Gottesman et al.
2008/0142004 A1 6/2008 Wasnick
2008/0142011 A1 6/2008 Aylsworth et al.
2008/0178880 A1 7/2008 Christopher et al.
2008/0178882 A1 7/2008 Christopher et al.
2008/0185002 A1 8/2008 Berthon-Jones et al.
2008/0190428 A1 8/2008 Yu
2008/0190429 A1 8/2008 Tatarek
2008/0196724 A1 8/2008 Nadjafizadeh et al.
2008/0200775 A1 8/2008 Lynn
2008/0200819 A1 8/2008 Lynn et al.
2008/0202528 A1 8/2008 Carter et al.
2008/0214357 A1 9/2008 Farinelli et al.
2008/0216830 A1 9/2008 Richards et al.
2008/0216834 A1 9/2008 Easley et al.
2008/0223361 A1 9/2008 Nieuwstad
2008/0236582 A1 10/2008 Tehrani
2008/0257345 A1 10/2008 Snyder et al.
2008/0257349 A1 10/2008 Hedner et al.
2008/0264412 A1 10/2008 Meyer et al.
2008/0264419 A1 10/2008 Lomask et al.
2008/0283060 A1 11/2008 Bassin
2008/0283062 A1 11/2008 Esposito, Jr.
2008/0295839 A1 12/2008 Habashi
2008/0295840 A1 12/2008 Glaw
2008/0302364 A1 12/2008 Garde et al.
2008/0308104 A1 12/2008 Blomberg et al.
2009/0007915 A1 1/2009 Brunner et al.
2009/0007916 A1 1/2009 Ralfs

OTHER PUBLICATIONS

"acapella® duet Vibratory PEP Therapy System with Medicated Aerosol Nubulizer", Smiths Medical, Asd, Inc. , (2 pages).
"Flutter® Mucus Clearance Device", Axcan Scandipharm, Inc., 2003, (11 pages).
"Introduction to Powerlung for Healthcare Professionals," Powerlung Incorporated, 2004, (4 pages).
"Powerlung Better Breathing User Guide", PowerLung, Inc., 2007 (6 pages).
International Preliminary Report on Patentability for PCT/US2009/041185 and Written Opinion, dated Nov. 4, 2010, 8 pages.
Expand a Lung Breathing Resistance Exerciser web advertisement, www.expand-a-lung.com, Copyright 2006-2008 Expand-a-Lung, printed Nov. 11, 2008 (2 pages).
Thayer Quake brochure, Copyright 2007 Thayer Medical Corporation (3 pages).
International Search Report and Written Opinion dated Jun. 12, 2009 for counterpart patent application PCT/US2009/041185 (10 pages).
European Search Report, for Application No. EP 09 73 6061, dated Oct. 6, 2011, 5 pages.

* cited by examiner

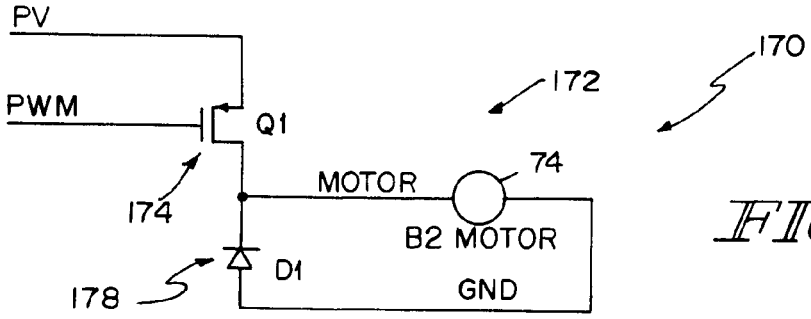
FIG 11
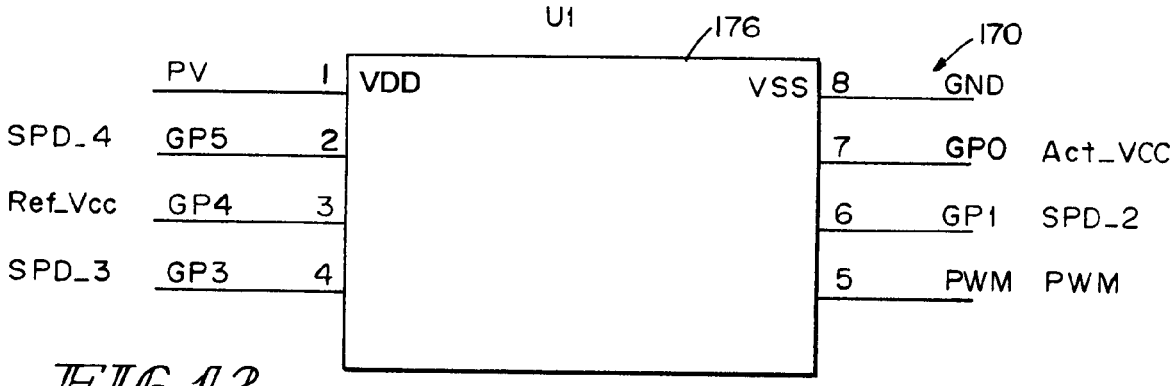
FIG 12
FIG 13
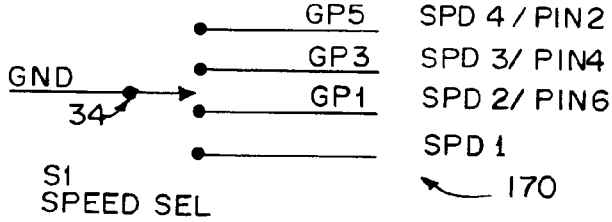
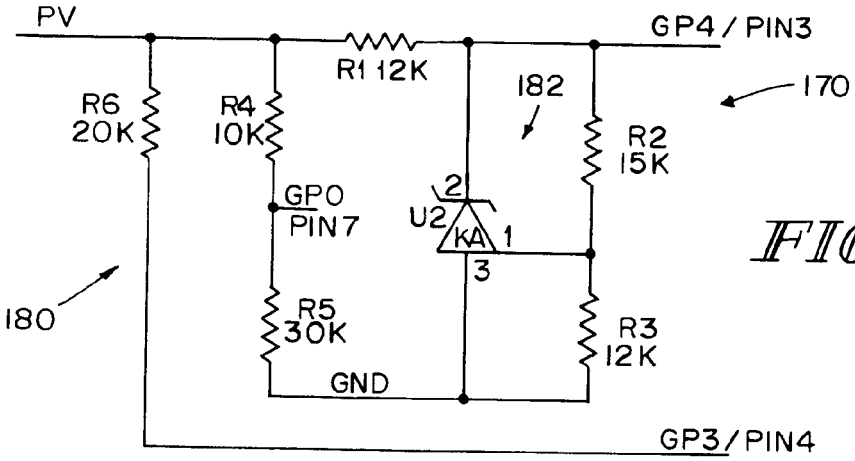
FIG 14

BREATHING EXERCISE APPARATUS

BACKGROUND

The present disclosure generally relates to a portable hand-held breathing exercise apparatus to vary the resistance a user experiences when both inhaling and exhaling through the apparatus.

It is known that by providing resistance to inspiration and expiration, pulmonary muscles are strengthened and developed, thereby allowing a freer and greater exchange of oxygen and carbon dioxide. Persons suffering from lung ailments, healthy persons, and athletes can all improve their pulmonary efficiency through inspiration and expiration against resistance. It is also known that vibration or percussion of the air during inspiration or expiration can provide relief to the patient by mobilizing the mucous, facilitating the expectoration thereof.

SUMMARY

The present invention comprises a breathing exercise apparatus having one or more of the features recited in the appended claims and/or one or more of the following features, which alone or in any combination may comprise patentable subject matter:

A breathing exercise apparatus may comprise a chamber having a vent open to the atmosphere, a mouthpiece having an opening, a stationary first member positioned in the chamber between the opening in the mouthpiece and the vent, a movable second member positioned in the chamber adjacent the first member, and an actuator coupled to the second member and operable to move the second member with respect to the first member such that an aperture in the second member intermittently aligns with an aperture in the first member.

In some embodiments, the second member may be positioned between the first member and the opening in the mouthpiece. In some other embodiments, the second member may be positioned between the first member and the vent of the chamber. The vent may comprise a plurality of vents.

The first and second members may include complementarily-shaped frusto-conical surfaces. The aperture of the first member may comprise a first plurality of apertures and the aperture in the second member may comprise a second plurality of apertures. The plurality of apertures in the first member may be equal to the plurality of apertures in the second member. The apertures in the first and second members may have substantially the same shape. In some embodiments, the apertures in the first and second members may be trapezoidal in shape. In some other embodiments, the apertures in the first and second members may be triangular in shape.

In some embodiments, the second member may be translatable relative to the first member. The actuator may be configured to move the second member back-and-forth relative to the first member. In some other embodiments, the second member may be rotatable relative to the first member. The actuator may be configured to rotate the second member continuously in one direction relative to the first member. In such embodiments, the actuator may comprise a motor having a drive shaft coupled to the second member. The second member and the drive shaft may be substantially coaxial. The resistance to a user's breathing may cyclically vary as the second member is rotated relative to the first member. The aperture in the second member may at least partially align with the aperture in the first member for 25% of each cycle.

In some embodiments, a breathing therapy apparatus may comprise a chamber having a vent open to the atmosphere, a mouthpiece having an opening which is in fluid communication with the vent allowing a user to breathe through the chamber, a valve positioned in the chamber between the opening and the vent, and an actuator coupled to the valve to cyclically open and close an aperture in the valve.

Additional features, which alone or in combination with any other feature(s), such as those listed above, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which:

FIGS. 11-14 are circuit diagrams showing components of a control system of the FIG. 1 apparatus;

DETAILED DESCRIPTION OF THE DRAWINGS

An illustrative hand-held, portable breathing therapy apparatus 10 is shown in FIGS. 1-15. Referring generally to FIGS.

Figure 2:
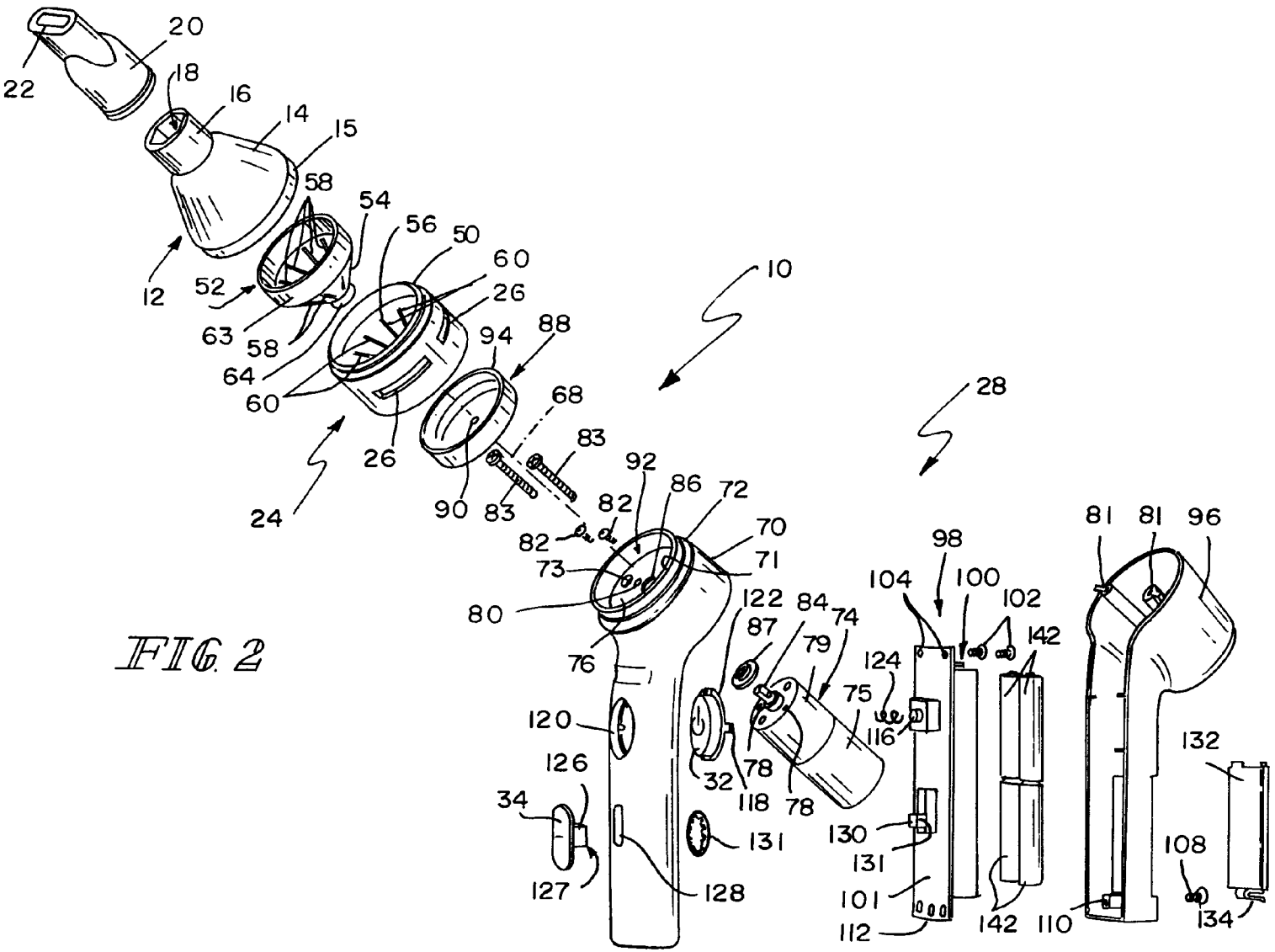
FIG. 2 is an exploded perspective view of the FIG. 1 apparatus showing, from left to right, a mouthpiece, a cap, a rotatable member including a frusto-conical portion having a plurality of apertures, a stationary member including a complementarily-shaped frusto-conical portion having a plurality of apertures, a gasket, a speed control switch, a front housing portion, a power switch, a motor, a control board, a plurality of batteries, a rear housing portion, and a battery compartment cover.

1-5 and particularly to FIG. 2, the apparatus 10 includes a cap 12 having a frusto-conical portion 14, a cylindrical portion 15 at one end, and a cylindrical portion 16 having an opening 18 at an opposite end. A mouthpiece 20 having an opening 22 is removably connected to the cap 12. The mouthpiece 20 is secured to the cylindrical portion 16 of the cap 12 through an interference fit in the illustrated embodiment. It should be appreciated, however, that the mouthpiece 20 can be secured to the cap 12 in other manners apparent to those of ordinary skill in the art.

Figure 4:
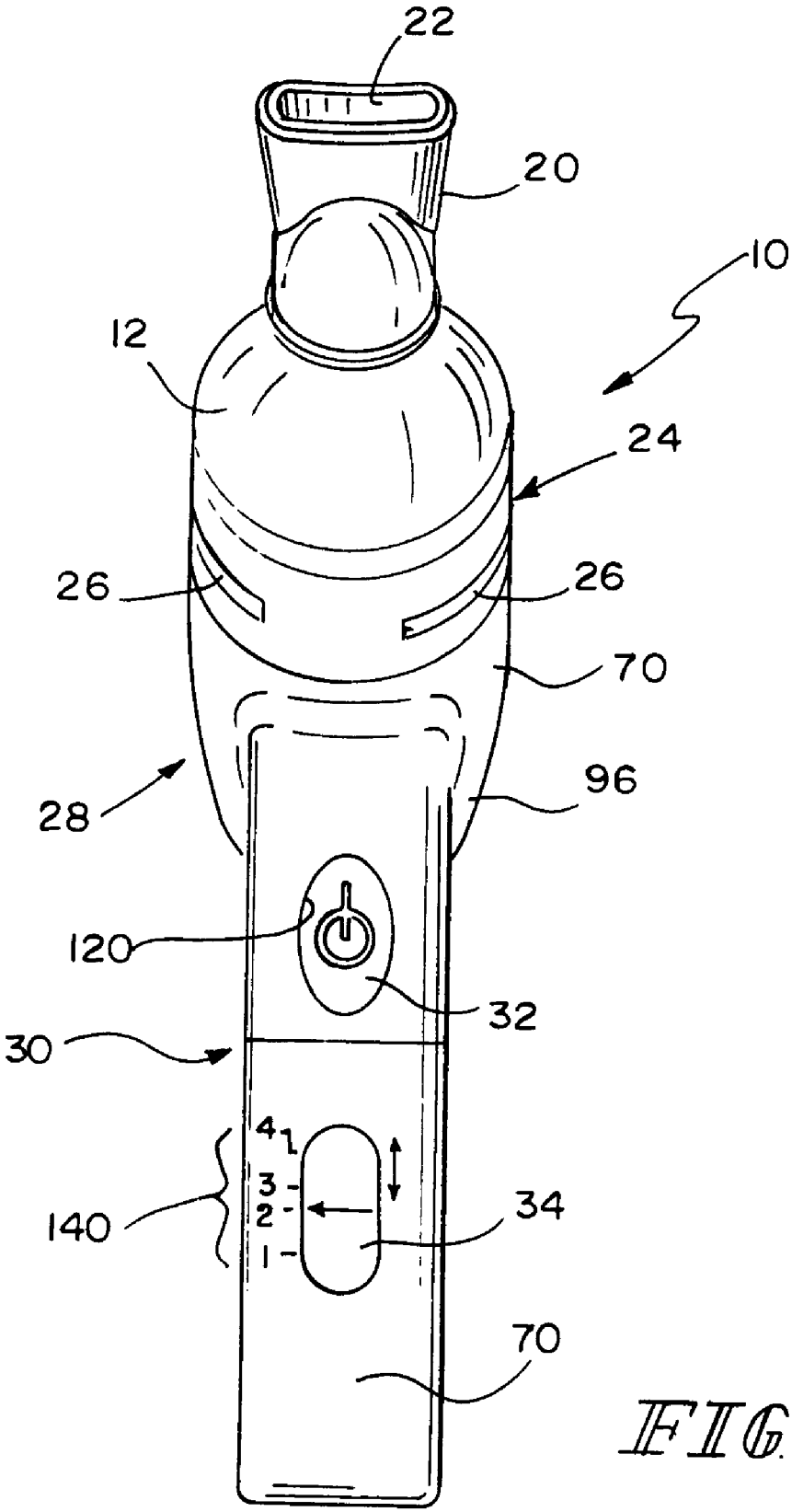
FIG. 4 is a front elevation view of the FIG. 1 apparatus.

In some embodiments, a mouthpiece may be integrally formed with the apparatus 10. In some other embodiments, a mouthpiece may be omitted. In such embodiments, the cylindrical portion 16 of the cap 12 having the opening 18 may serve as the mouthpiece. The cap 12 is coupled to a stationary member 24 which has a plurality of circumferentially-extending vents 26 formed in an outer wall thereof. The apparatus 10 includes a housing 28 comprising front and rear housing portions 70, 96. The lower portions of the front and rear housing portions 70, 96 define a downwardly-extending handle portion 30. As shown in FIG. 4, the handle portion 30 carries a power switch 32 and a speed control switch 34.

Figure 1:
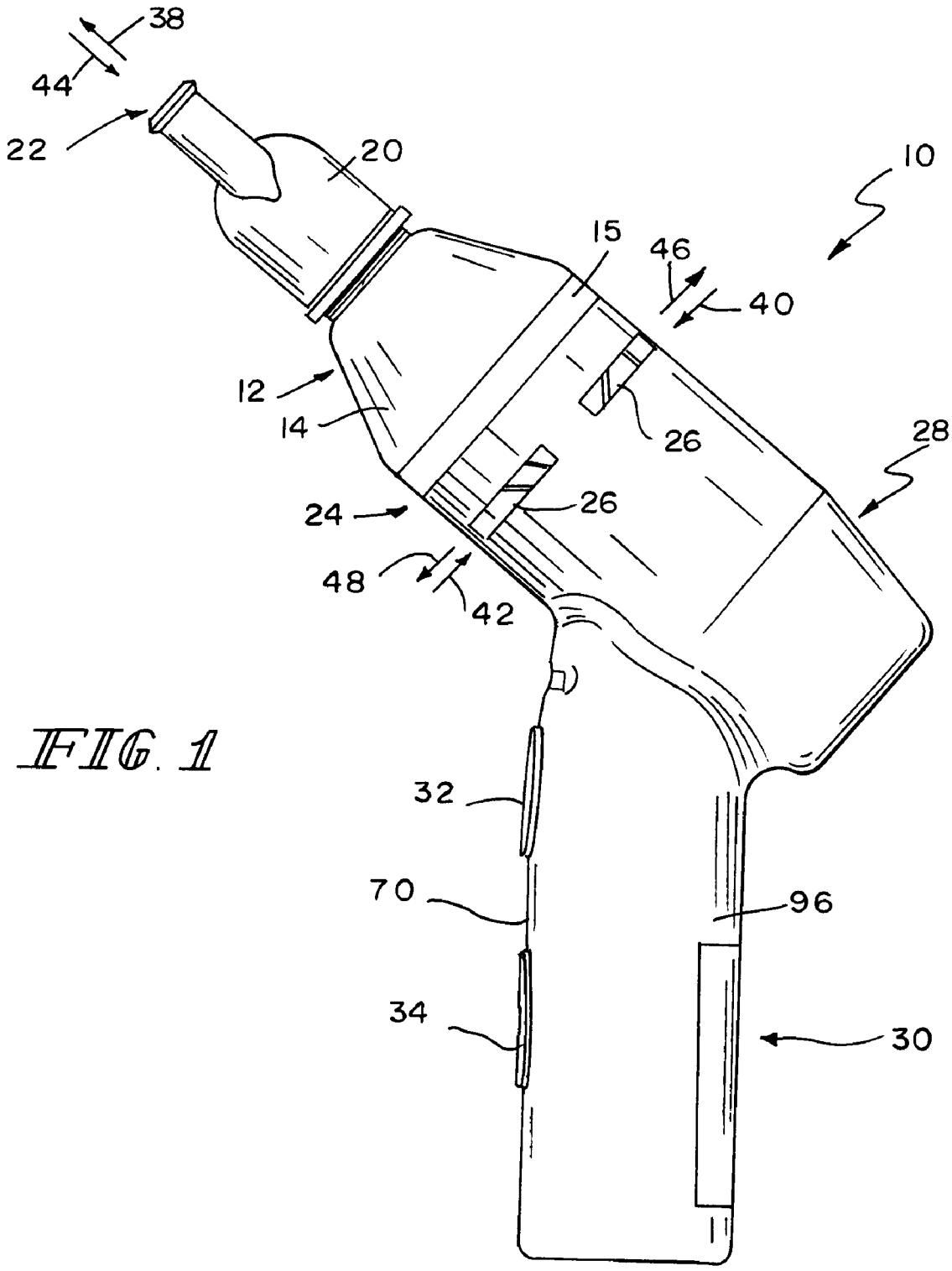
FIG. 1 is a side elevation view of a breathing exercise apparatus.

When the mouthpiece 20 is connected to the apparatus 10, a user can place the mouthpiece 20 in his or her mouth and breathe through the mouthpiece 20, which is in fluid communication with the atmosphere through a chamber 17 (FIG. 3) and through the plurality of vents 26 in the stationary member 24. The power switch 32 can be engaged allowing internal components (see FIGS. 2-3) of the apparatus 10 to be operated to vary breathing resistance experienced by a user when breathing through the apparatus 10, both during inspiration and expiration. As shown in FIG. 1, a user may inhale through the mouthpiece 20, as indicated by arrow 38, drawing air from the atmosphere into the chamber 17 through the vents 26 as indicated by arrows 40, 42. Likewise, a user may exhale through the apparatus 10, as indicated by arrow 44, such that the user's breath may be vented to the atmosphere through the chamber 17 and through the vents 26, as indicated by arrows 46, 48. As further described herein, internal components of the apparatus 10 may cyclically vary the resistance a user experiences when both inhaling and exhaling through the apparatus 10.

Figure 3:
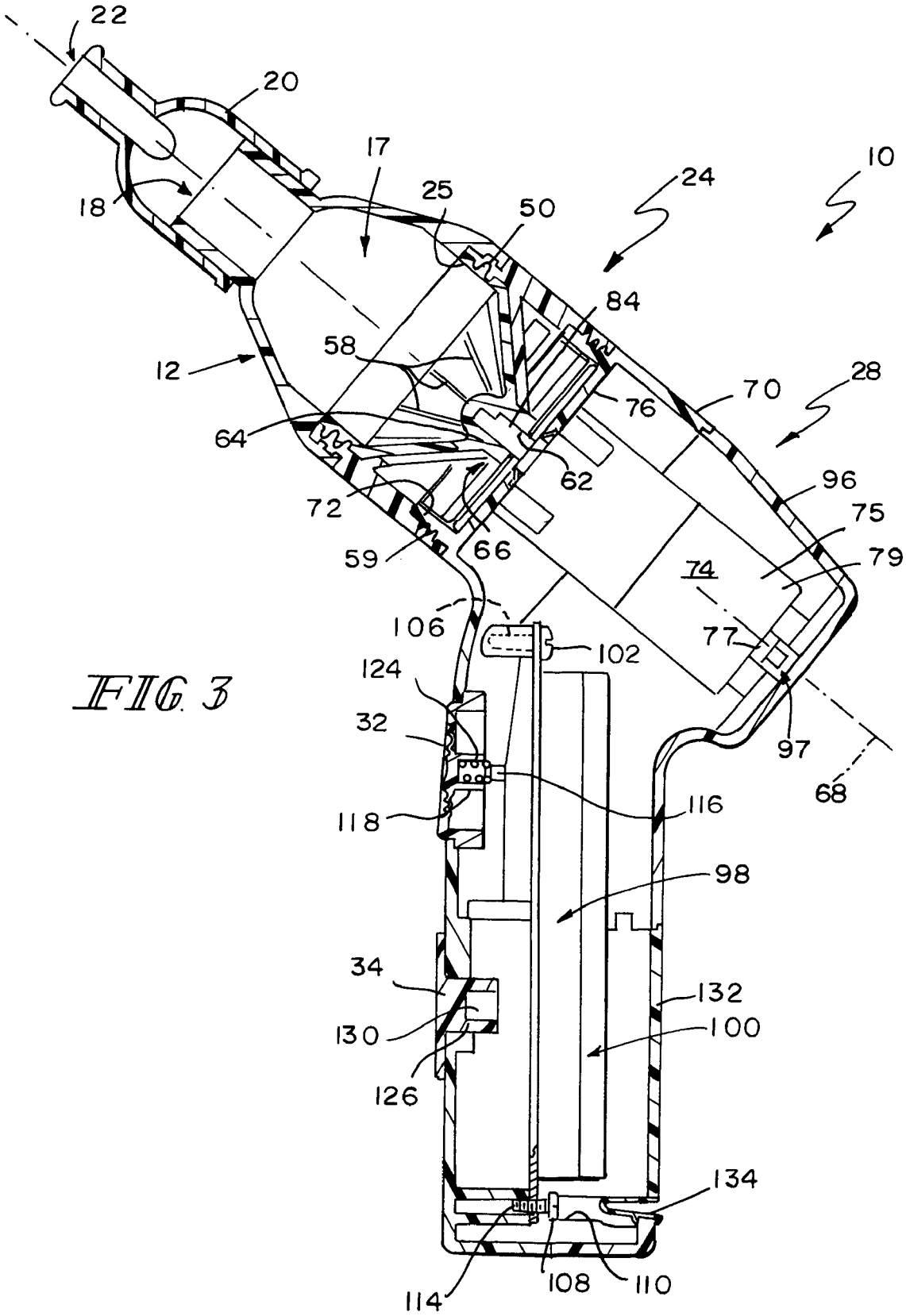
FIG. 3 is a sectional view of the FIG. 1 apparatus generally along a longitudinal center line 3-3 thereof.

As shown in FIGS. 2-3, the stationary member 24 includes a threaded portion 50, which interacts with a threaded portion 25 disposed on an inner surface of the cap 12 (see FIG. 3) allowing the cap 12 to be secured to the stationary member 24. A rotating member 52 is disposed between the opening 18 in the cap 12 and the vents 26 in the stationary member 24. The rotating member 52 includes a frusto-conical portion 54, a cylindrical portion 63 at one end, and a cylindrical portion 64 at an opposite end. The stationary member 24 includes an inwardly-extending frusto-conical portion 56, which is complementarily-shaped with respect to the frusto-conical portion 54 of the rotating member 52. The complementary shaping allows the frusto-conical portion 54 of the rotating member 52 to be disposed within the frusto-conical portion 56 of the stationary member 24 such that the frusto-conical portion 54 of the rotating member 52 contacts or nearly contacts the frusto-conical portion 56 of the stationary member 24.

Figure 8:
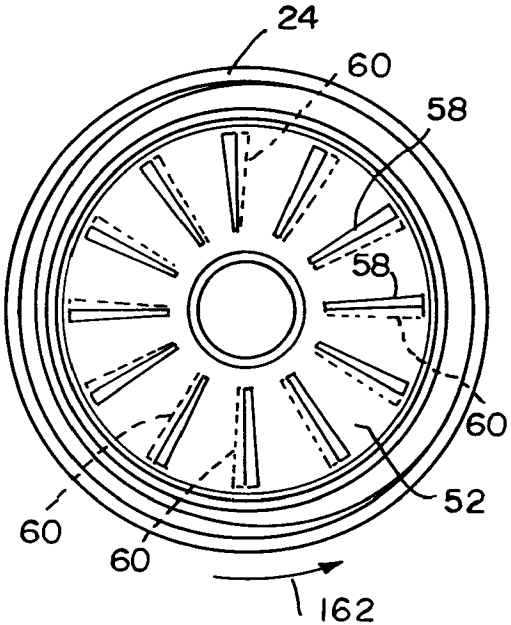
FIGS. 6-8 are cross-sectional views showing the interaction between the apertures in the frusto-conical portion of the rotating member and the apertures in the frusto-conical portion of the stationary member as the rotating member is rotated.
Figure 7:
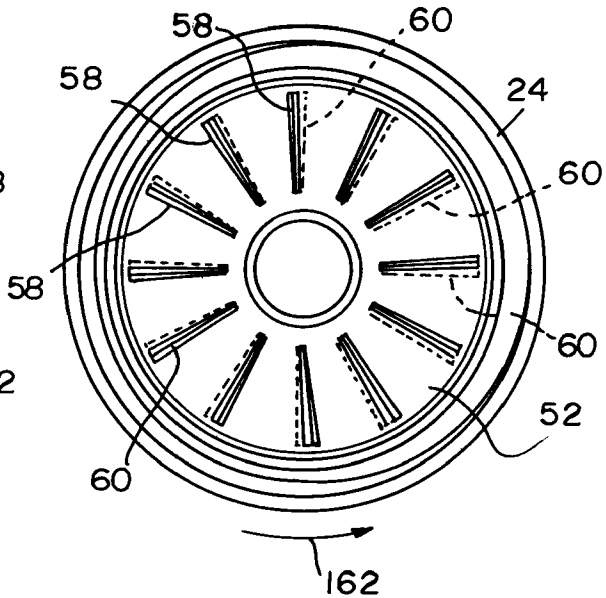
Figure 6:
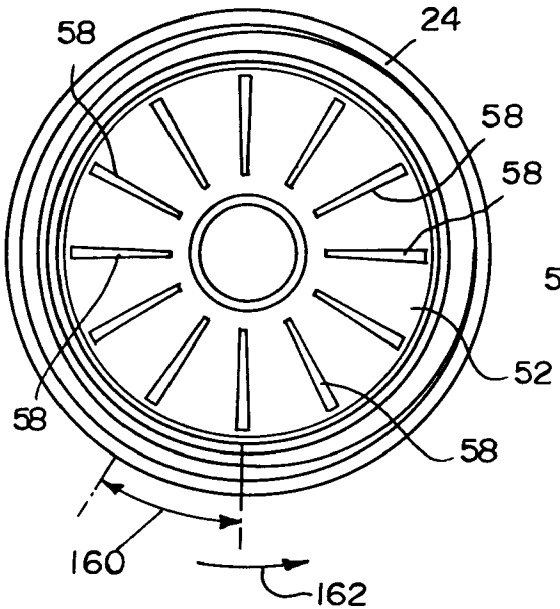

The frusto-conical portion 54 of the rotating member 52 includes a plurality of through apertures 58 disposed therein. Similarly, the frusto-conical portion 56 of the stationary member 24 includes a plurality of apertures 60. In one embodiment of the apparatus 10, the number of apertures 58 in the rotating member 52 is the same as the number of apertures 60 in the stationary member 24. As shown in FIGS. 6-8, this configuration allows the apertures 58 in the rotating member 52 to intermittently align with the apertures 60 in the stationary member 24 as the rotating member 52 rotates.

When the frusto-conical portion 54 of the rotating member 52 is received in the frusto-conical portion 56 of the stationary member 24 as shown in FIG. 3, the rotating member 52 and the stationary member 24 are axially aligned along a central axis 68 of the apparatus 10 and the projection 64 of the rotating member 52 extends through a centrally-disposed opening 66 (see FIG. 3) in the stationary member 24 The front housing portion 70 includes threaded portion 72, which engages a threaded portion 59 on an interior surface of the stationary member 24 (see FIG. 3) allowing the stationary member 24 to be secured to the front housing portion 70.

Referring to FIGS. 2-3, a motor 74, which includes a transmission section 75, can be used to actuate rotation of the rotating member 52. It should be appreciated that the internal details of the motor 74 are not shown and those of ordinary skill in the art readily recognize that a suitable conventional motor is used in the apparatus 10. The motor 74 is mounted to a mounting surface 76 of the front housing portion 70 via threaded openings 78 in casing 79 of the motor 74, which are aligned with openings 80 in the mounting surface 76. Fasteners 82 extend through the openings 80 in the mounting surface 76 and screwed into the threaded openings 78 in the casing 79 of the motor 74 to mount the motor 74 to the mounting surface 76. As shown in FIG. 3, the casing 79 of the motor 74 has a rearwardly-extending projection 77. The rearwardly-extending projection 77 is seated in a complementarily-contoured notch 97 of the rear housing portion 96 to further secure the motor 74 within the housing 28. In FIG. 2, the fasteners 82 are illustratively embodied as flat-ended screws. It should be appreciated that various suitable fasteners apparent to one of ordinary skill in the art may be used alternatively.

As shown in FIG. 2, a rotor or drive shaft 84 of the motor 74 is configured to extend through a bearing 87, an opening 86 in the mounting surface 76, and through an opening 90 of a gasket 88. As shown in FIG. 3, the rotor 84 extends through the opening 66 of the stationary member 24 and is seated within a complementarily-contoured cavity 62 in the rearwardly-extending projection 64 of the rotating member 52. A flat portion of the rotor 84 engages a flat portion of an internal wall of the cavity 62, with a round portion of the rotor 84 engaging a round section of the cavity 62 to rotatably couple the rotating member 52 to the rotor 84. In the illustrative embodiment, the motor 74 is configured to rotate the rotating member 52 continuously in one direction, for example, a counterclockwise direction 162 as shown in FIGS. 6-8.

The gasket 88 is positioned within a cavity 92 of the front housing portion 70. The gasket 88 has a circumferential flange 94, which engages an end face 71 of the threaded portion 72 of the front housing portion 70 when the gasket 88 is positioned within the cavity 92. The front and rear housing portions 70, 96 are connected together to enclose the motor 74, as well as a control board 98 and a battery compartment 100. Each fastener 83 is disposed through an opening 73 in the mounting surface 76 of the front housing portion 70 and screwed into a threaded opening 81 in the rear housing portion 96 to secure the housing portions 70, 96 to one another. The fasteners 83 are illustratively embodied as flat-end screws in FIG. 2, however, it should be appreciated that other suitable fasteners apparent to one of ordinary skill in the art may be alternatively used.

As shown in FIG. 2, the control board 98 includes printed circuit board (PCB) panel 101. The motor 74 is connected to the control board 98 through conventional motor leads (not shown). An internal power switch 116 and an internal speed control switch 130 are mounted to the panel 101. Fasteners 102 are disposed through openings 104 in the panel 101 and into openings 106 (see FIG. 3) in the front housing portion 70 allowing the panel 101 to be secured to the front housing portion 70. A fastener 108 is disposed through an opening 110 of the rear housing portion 96 and an opening 112 of the panel 101 and screwed into a threaded opening 114 (see FIG. 3) of the front housing portion 70. The fastener 108 secures the front and rear housing portions 70, 96 to one another, with the panel 101 sandwiched between the front and rear housing portions 70, 96. The fasteners 102, 108 are illustratively embodied as flat-end screws in FIG. 2, however, it should be appreciated that other suitable fasteners apparent to one of ordinary skill in the art may be alternatively used.

As shown in FIGS. 2-3, the power switch 32 is connected to the internal power switch 116 through a stem 118. The power switch 32 is disposed through an opening 120 in the handle portion 30 of the front housing portion 70. The switch 32 is complementarily-shaped with the opening 120. A flange 122 around the edge of the switch 32 secures the switch 32 to the front housing portion 70. A spring 124 disposed between the switches 32, 116 biases the power switch 32 outwardly to provide a "push-button" power switch arrangement. It should be appreciated that the power switch 32 may be embodied by a number of different switch configurations, such as, for example, a touch sensor switch or a slide switch. In one embodiment, the "off" position of the switch 32 is in a raised position as compared to the "on" position with respect to the front housing portion 70. It should be appreciated that the internal power switch 116 includes an internal spring (not shown) to bias the internal power switch 116 outwardly as well.

As shown in FIGS. 2-3, a speed control switch 34 includes a stem 126 disposed through a slot 128 formed in the front housing portion 70. The stem 126 is secured to the front housing portion 70 with a retaining clip 131. The stem 126 includes a recess 127 in which a post 131 of the internal speed control switch 130 is received. The switch 34 is slidable along the slot 128, which causes sliding of the internal speed control switch 130. In the illustrative embodiment shown in FIG. 2, the switch 34 is slidable into four preset positions 140 (see FIG. 4), with each position representing a preset speed. A battery compartment panel 132 is removably attached to the rear housing portion 96 by a leaf spring 134 on the panel 132. The panel 132 allows access to the battery compartment 100.

During operation of the apparatus 10, the power switch 32 may be positioned into the "on" position, which causes the rotor 84 to begin rotating at the speed set by the speed control switch 34. Rotation of the rotor 84 is translated to the coupled rotating member 52. As the rotating member 52 rotates, the apertures 58 in the frusto-conical portion 54 of the rotating member 52 intermittently align with the apertures 60 in the frusto-conical portion 56 of the stationary member 24. As the user inhales, air is drawn into the chamber 17 through the vents 26. As the apertures 58 intermittently align with the apertures 60, the user will experience a cyclically-varying breathing resistance. The user will experience a similar resistance with exhaling. The interaction of the apertures 58, 60 is described in greater detail in regard to FIGS. 6-8.

As shown in FIG. 4, an indicia 140 is coupled to the handle portion 30 of the housing 28. In the illustrative embodiment, the indicia 140 presents four speeds at which the rotating member 52 may rotate. The speed control switch 34 can be shifted to any of the four speeds 1, 2, 3, and 4. It should be appreciated that other embodiments of the apparatus 10 may have more than or less than four speeds available. It should be further appreciated that each of the indicia 140 may indicate various available speeds in no particular order. For example, the indicia 1 may indicate the lowest or highest speed available or a speed in between.

Figure 5:
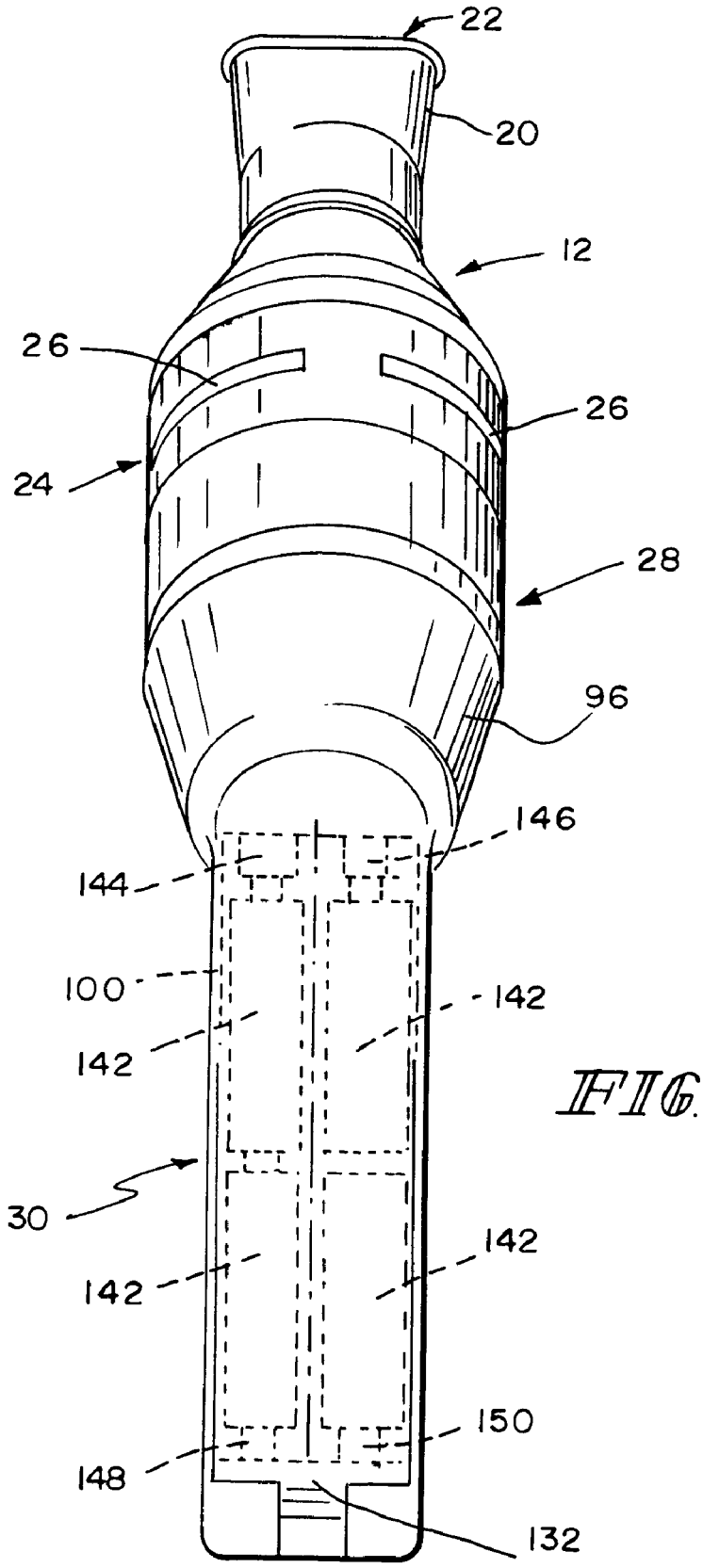
FIG. 5 is a rear elevation view of the FIG. 1 apparatus.

Referring to FIG. 5, a plurality of batteries 142 (shown in phantom) are received within the battery compartment 100. Contacts 144, 146 provide contacts to the positive terminals of the batteries 142 and the contacts 148, 150 provide contacts to the negative terminals of the batteries 142. The contacts 144, 146, 148, 150 are electrically connected to the control board 98 in order to provide power to the motor 74 for rotation of the rotating member 52. In the illustrative embodiment, four AAA-sized batteries are used to power the apparatus 10. It should be appreciated that the apparatus 10 can be configured to use other battery sizes, both rechargeable and disposable. It should be further appreciated that the apparatus 10 may be configured to have an electrical plug, allowing it to be plugged into a standard AC outlet for powering the apparatus 10, recharging the batteries 142, or both.

FIGS. 6-8 are cross-sectional views showing the interaction between the apertures 58 in the frusto-conical portion 54 of the rotating member 52 and the apertures 60 in the frusto-conical portion 56 of the stationary member 24 as the rotating member 52 is rotated. In this illustrative embodiment, the rotating and stationary members 52, 24 each include the same number of similarly-shaped apertures 58, 60, respectively. FIG. 6 shows the rotating member 52 in a fully open position, in which each aperture 58 in the rotating member 52 is aligned with a respective aperture 60 in the stationary member 24. As the rotating member 52 rotates, the apertures 58 in the rotating member 52 partially align with the apertures 60 in the stationary member 60, as shown, for example, in FIG. 7, defining a partially open position. FIG. 8 shows the rotating member 52 in a fully closed position, in which none of the apertures 58 in the rotating member 52 align with any of the apertures 60 in the stationary member 24. Thus, the rotating and stationary members 52, 24 function as a valve having a plurality of openings that open and close as the rotating member 52 rotates.

As a user breathes through the mouthpiece 20, the rotation of the rotating member 52 with respect to the stationary member 24 cyclically aligns the apertures 58 in the frusto-conical portion 54 of the rotating member 52 with the apertures 60 in the frusto-conical portion 56 of the stationary member 24 to vary the breathing resistance experienced by the user. As illustrated in FIG. 6, one cycle may be considered as the distance the rotating member 52 travels from a position where an aperture 58 is fully aligned with an aperture 60 to a position where said aperture 58 is fully aligned with a directly adjacent aperture 60, as indicated by the distance 150.

Figure 9:
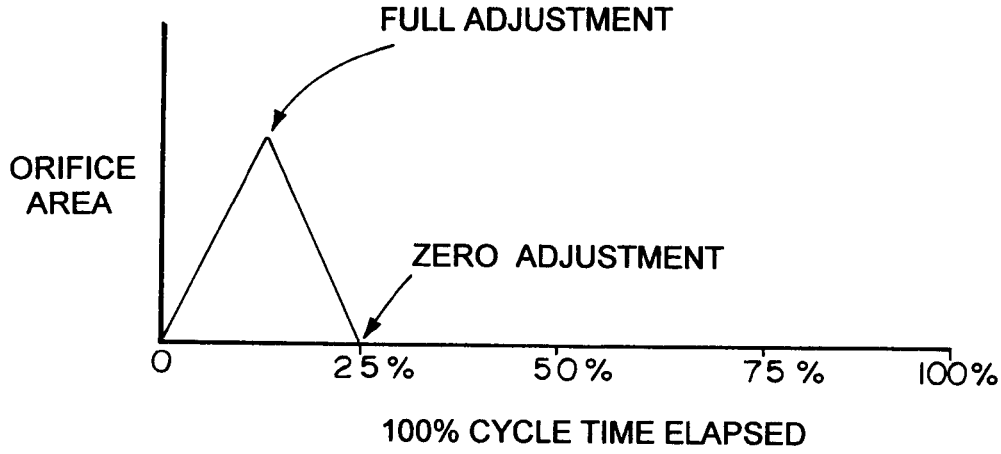
FIG. 9 is a graph showing a percentage cycle time along the horizontal axis and the alignment area between the apertures in the stationary member and the apertures in the rotating member along the vertical axis.

As the apertures 58, 60 very in alignment with one another as shown in FIGS. 6-8, the pressure in the chamber 17 between the mouthpiece 20 and the rotating member 52 varies. In one illustrative embodiment, the apertures 58, 60 may be shaped and dimensioned to follow the waveform profile shown in FIG. 9. FIG. 9 is a plot of one cycle, as defined above, of the rotation of the rotating member 52 (i.e., the rotating member 52 travels through the distance 160). The vertical axis of FIG. 6 indicates the orifice area, which is the area of alignment between an aperture 58 and an aperture 60 as the rotating member 52 is rotated. The horizontal axis of FIG. 6 indicates the percentage of cycle time elapsed. The plot of FIG. 7 begins at an instant immediately prior to the aperture 58 beginning to align with an aperture 60 (i.e., "0" along the horizontal axis). The shapes and dimensions of the apertures 58, 60, shown in FIGS. 6-8, allow the area of alignment between the apertures 58, 60 to increase linearly to full alignment of the apertures 58, 60, as shown in FIG. 6. As the rotating member 52 continues to rotate, the area of alignment between the apertures 58, 60 begins to linearly decrease, as shown in FIG. 7, until the apertures 58, 60 no longer align, as shown in FIG. 8. As shown in FIG. 9, in the illustrated embodiment, the apertures 58, 60 will have some alignment for 25% of the cycle time, with no alignment occurring for 75% of the cycle time.

Figure 10:
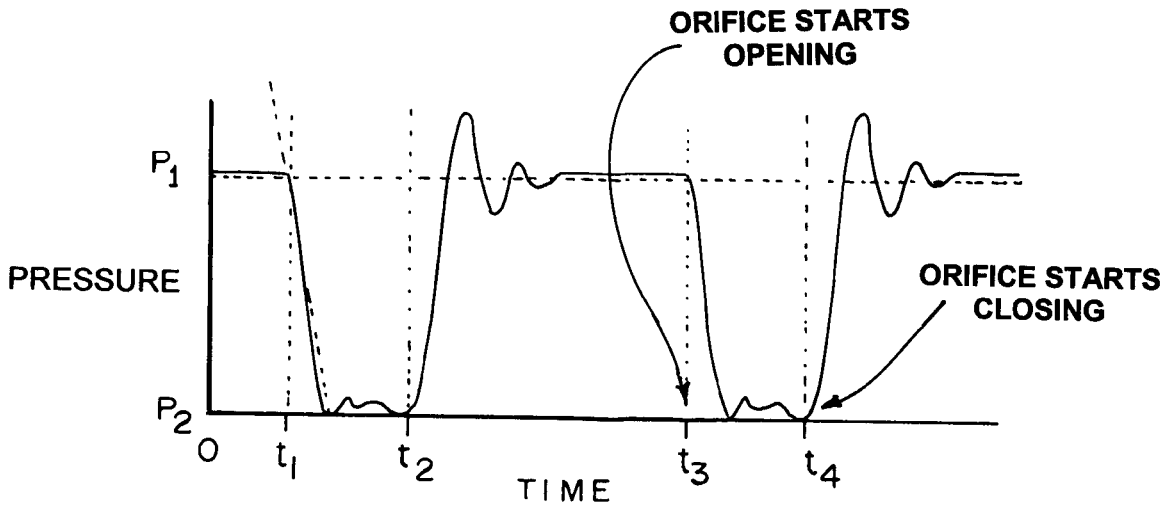
FIG. 10 is a graph showing the time along the horizontal axis and a pressure in the chamber along the vertical axis.

As a user breathes through the apparatus 10, alignment of the apertures 58, 60 in the apparatus 10 results in a pressure characteristic plot as shown in FIG. 10 to occur in the chamber 17 between the opening 22 in the mouthpiece 20 and the rotating member 52. The plot of FIG. 10 includes time along the horizontal axis and the pressure in chamber 17 along the vertical axis. Time $t_1$ in FIG. 10 is the instant prior to the apertures 58 of the rotating member 52 beginning to align with the apertures 60 in the stationary member 24, which is the cycle time percentage "0" in FIG. 9. Prior to time $t_1$, the pressure in the chamber 17 is at a base pressure, designated as $P_1$. As the apertures 58 begin to overlap the apertures 60, the pressure in the chamber 17 begins to decrease due to the alignment of the apertures 58, 60, allowing the opening 22 in the mouthpiece 20 to be in fluid communication with the atmosphere via the vents 26.

The pressure in the chamber 17 will decrease towards a pressure slightly above atmospheric designated as $P_2$ in FIG. 10. As shown in FIG. 10, the pressure in the chamber 17 fluctuates about $P_2$ prior to time $t_2$, which is due to a mass of air from a user breathing entering the chamber 17. At time $t_2$, the overlap between the apertures 58, 60 begins to decrease, which causes the pressure in the chamber 17 to increase as the user breathes through the apparatus 10. Once there is no overlap of the apertures 58, 60 and the conditions stabilize in the chamber 17, the pressure in the chamber 17 reaches the steady state pressure $P_1$. At time $t_3$, a new cycle begins.

FIGS. 11-14 show a control system 170 for the apparatus 10. FIG. 11 shows a drive circuit 172, which includes the motor 74. The motor 74 is electrically connected to the drain of a metal oxide semiconductor field-effect transistor (MOSFET) 174. In FIG. 11, the MOSFET 174 is illustratively embodied as a NTR4101 MOSFET. However, it should be appreciated that other suitable MOSFETs may be used. The source of the MOSFET 174 is selectively electrically connected to a power source, such as the batteries 142 through the power switch 32. The connection is designated in FIG. 11 as the line "PV." The gate of the MOSFET 162 is connected to a pulse-width-modulated (PWM) signal generated by a microprocessor 176. As the PWM signal is provided to the gate of the MOSFET 174, a current may flow from the power source PV to the motor 74 in order to operate it. A diode 178 is electrically connected between the leads of the motor 74 in order to ensure that the current flows in a single direction into the motor 74. In FIG. 11, the diode 178 is illustratively embodied as a S1AB diode. However, various suitable diodes may be used as an alternative to the S1AB diode.

Referring now to FIG. 12, the microprocessor 176 controls the PWM signal transmitted to the MOSFET 174. A pin 1 of the microprocessor 176 is connected to the power supply such as the batteries 142. Pins 2, 4, 6 are each used for speed control of the motor 74. In particular each pin 2, 4, 6 is selectively connectable to the speed control switch 34 as schematically shown in FIG. 13. When the speed control switch 34 is connected to one of the pins 2, 4, 6 a circuit is completed with the particular pin, allowing the PWM signal to be adjusted appropriately by the microprocessor 176. In the illustrative embodiment, the speeds are designated as SPD4, SPD3, SPD2, and SPD1, from the highest to the lowest speed. Thus, a connection with the pin 2 (FIG. 13) by the speed selection switch 34, which corresponds to SPD4, selects the highest speed. The selection of the SPD1 connection prevents any of the pins 2,4,6 from being connected with the speed control switch 34, which indicates to the microprocessor 176 that the lowest speed setting is desired and the PWM signal applied to the gate of the MOSFET 174 is adjusted accordingly.

Referring to FIG. 14, the power supply voltage through the line PV is compared to a reference voltage to adjust the PWM signal so that as the power supply diminishes, such as when the batteries 142 begin to weaken, the PWM signal is adjusted accordingly. For example, if the batteries 142 begin to weaken, the duty cycle may be increased for a particular speed setting to compensate for the loss of battery power. A voltage comparison circuit 180 is used to compare a reference voltage to the power supply voltage on the PV line. As shown, the circuit 180 includes a number of resistive elements interconnected with one another. The circuit 180 is also connected to pins 3, 4, and 7 of the microprocessor 176. The circuit 180 includes a reference voltage component 182, which is illustratively embodied as LM4041. However, it should be appreciated that various suitable voltage reference components may be used.

Figure 15:
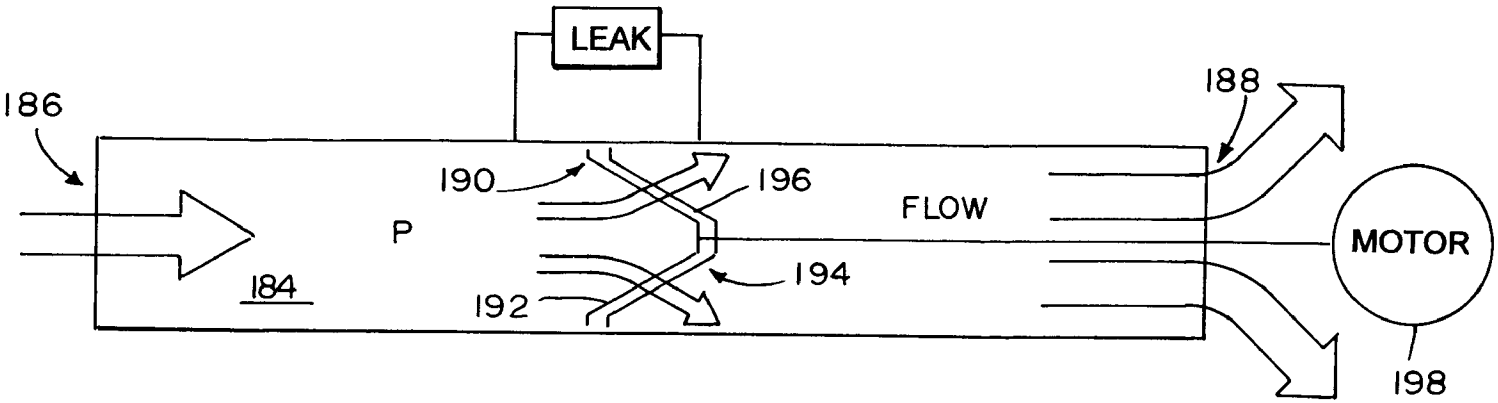
FIG. 15 is a diagrammatic view of the FIG. 1 apparatus showing a chamber having an opening at one end configured to be in communication with a user's mouth and a vent at an opposite end in communication with the atmosphere, a rotating member including a frusto-conical portion having a plurality of apertures, a stationary member including a complementarily-shaped frusto-conical portion having a plurality of apertures, and a motor coupled to the rotating member and operable to cause rotation thereof relative to the stationary member.

FIG. 15 diagrammatically shows the FIG. 1 apparatus 10 including a chamber 184 having an opening 186 at one end thereof configured to be in communication with a user's mouth and a vent 188 at an opposite end thereof in communication with the atmosphere, a rotating member 190 including a frusto-conical portion 192 having a plurality of apertures (not shown), a stationary member 194 including a complementarily-shaped frusto-conical portion 196 having a plurality of apertures (not shown), and a motor 198 coupled to the rotating member 190 and operable to cause the rotation thereof relative to the stationary member 194 to vary the resistance a user experiences when both inhaling and exhaling through the apparatus.

Figure 16:
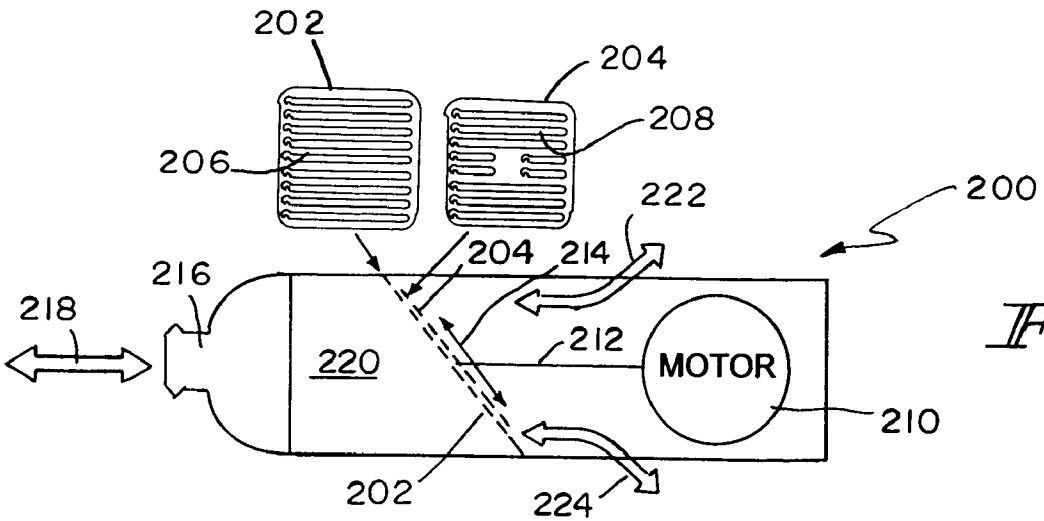
FIG. 16 is a diagrammatic view of another embodiment of the FIG. 1 apparatus showing a chamber having an opening at one end configured to be in communication with a user's mouth and a vent at an opposite end in communication with the atmosphere, a stationary member having a plurality of slots, a shiftable member having a plurality of slots, and a motor coupled to the shiftable member and operable to cause back-and-forth movement thereof relative to the stationary member.

FIG. 16 diagrammatically shows an alternative configuration of a breathing therapy apparatus 200. The apparatus 200 includes a stationary screen 202 and a reciprocating screen 204. Each screen 202, 204 includes a plurality of slots 206, 208, respectively. The screen 202 is secured in a stationary position within the apparatus 200. The screen 204 is positioned against the screen 202 and connected to a motor 210 via a link 212. The motor 210 causes the reciprocating screen 204 to move back-and-forth across the screen 202 as indicated by arrow 214. The slots 206, 208 vary in alignment relative to each other as the screen 204 moves back-and-forth. In the illustrative embodiment, the alignment can vary between full aligned to no alignment. This provides similar result as described in regard to the apparatus 10. The motor 210 is connected to a speed control system, such as the speed control system 170. As a user breathes through a mouthpiece 216, as indicated by a double-headed arrow 218, a user's breath may be vented or the air may be drawn into the chamber 220 of the apparatus 190 as indicated by the arrows 222, 224, through vents similar to the vents 26 in the apparatus 10.

Although certain illustrative embodiments have been described in detail above, variations and modifications exist within the scope and spirit of this disclosure as described and as defined in the following claims.

The invention claimed is:

1. A breathing exercise apparatus comprising:

a chamber having a vent open to the atmosphere, a mouthpiece having an opening which is in fluid communication with the vent allowing a user to breathe through the chamber, a first member positioned in the chamber between the opening in the mouthpiece and the vent, the first member having an aperture, a second member positioned in the chamber adjacent the first member, the second member having an aperture, and an actuator coupled to the second member and operable to move the second member with respect to the first member such that the aperture in the second member intermittently aligns with the aperture in the first member.

2. The apparatus of claim 1, wherein the resistance to a user's breathing is cyclically varied as the second member is rotated relative to the first member.

3. The apparatus of claim 2, wherein the aperture in the second member at least partially aligns with the aperture in the first member for 25% of each cycle.

4. The apparatus of claim 1, wherein the first and second members are complementarily shaped with respect to one another.

5. The apparatus of claim 4, wherein the first and second members include frusto-conical portions.

6. The apparatus of claim 1, wherein the aperture of the first member comprises a plurality of apertures and the aperture in the second member comprises a plurality of apertures.

7. The apparatus of claim 6, wherein the plurality of apertures in the first member is equal to the plurality of apertures in the second member.

8. The apparatus of claim 6, wherein the apertures in the first and second members have substantially the same shape.

9. The apparatus of claim 6, wherein the apertures in the first and second members are trapezoidal in shape.

10. The apparatus of claim 9, wherein the apertures in the first and second members are triangular in shape.

11. The apparatus of claim 1, wherein the second member is positioned between the first member and the opening in the mouthpiece.

12. The apparatus of claim 1, wherein the second member is positioned between the first member and the vent.

13. The apparatus of claim 1, wherein the second member is rotatable relative to the first member, and the actuator is configured to rotate the second member continuously in one direction.

14. The apparatus of claim 13, wherein the actuator comprises a motor having a drive shaft coupled to the second member.

15. The apparatus of claim 14, wherein the second member and the drive shaft are substantially coaxial.

16. The apparatus of claim 1, wherein the second member is translatable relative to the first member, and the actuator is configured to move the second member back-and-forth relative to the first member.

17. The apparatus of claim 1, wherein the vent comprises a plurality of vents.

18. A breathing exercise apparatus comprising:

a housing comprising a mouthpiece having an opening and a chamber having a vent open to the atmosphere, the opening in the mouthpiece being in fluid communication with the vent allowing a user to breathe through the chamber, a stationary member positioned in the chamber between the opening in the mouthpiece and the vent, the stationary member having a plurality of apertures, a movable member positioned in the chamber adjacent the stationary member, the movable member having a plurality of apertures, and an actuator coupled to the movable member and operable to move the movable member with respect to the stationary member such that the apertures in the movable member intermittently align with the apertures in the stationary member.

19. The apparatus of claim 18, wherein the movable member is rotatable relative to the stationary member, and the actuator is configured to rotate the movable member continuously in one direction.

20. The apparatus of claim 18, wherein the movable member is translatable relative to the stationary member, and the actuator is configured to move the movable member back-and-forth relative to the stationary member.

21. A breathing therapy apparatus comprising:

a chamber having a vent open to the atmosphere, a mouthpiece having an opening which is in fluid communication with the vent allowing a user to breathe through the chamber, a valve member positioned in the chamber between the opening in the mouthpiece and the vent of the chamber, the valve member including a frusto-conical shaped portion having an aperture, and an actuator coupled to the valve member to cyclically open and close the aperture in the valve member via rotation of the valve member to intermittently move the aperture past a second aperture in the chamber.

* * * * *